US010875082B2

(12) United States Patent
Otto

(10) Patent No.: US 10,875,082 B2
(45) Date of Patent: Dec. 29, 2020

(54) FORMING MACHINE, IN PARTICULAR FORGING HAMMER, AND METHOD FOR CONTROLLING A FORMING MACHINE

(71) Applicant: Langenstein & Schemann GmbH, Coburg (DE)

(72) Inventor: Markus Otto, Lautertal (DE)

(73) Assignee: LANGENSTEIN & SCHEMANN GMBH, Coburg (DE)

( * ) Notice: Subject to any disclaimer, the term of this patent is extended or adjusted under 35 U.S.C. 154(b) by 517 days.

(21) Appl. No.: 15/565,157

(22) PCT Filed: Mar. 18, 2016

(86) PCT No.: PCT/EP2016/055950
§ 371 (c)(1),
(2) Date: Feb. 21, 2018

(87) PCT Pub. No.: WO2016/162184
PCT Pub. Date: Oct. 13, 2016

(65) Prior Publication Data

US 2018/0185900 A1 Jul. 5, 2018

(30) Foreign Application Priority Data

Apr. 9, 2015 (DE) ..... 10 2015 105 400

(51) Int. Cl.
*B21J 7/28* (2006.01)
*B30B 15/16* (2006.01)
(Continued)

(52) U.S. Cl.
CPC . *B21J 7/28* (2013.01); *B21J 7/46* (2013.01); *B21J 9/12* (2013.01); *B21J 9/20* (2013.01); *B21J 11/00* (2013.01); *B30B 15/16* (2013.01)

(58) Field of Classification Search
CPC ... B30B 15/161; B30B 15/163; B30B 15/183; B30B 15/186; B30B 15/22;
(Continued)

(56) References Cited

U.S. PATENT DOCUMENTS 3,742,820 A * 7/1973 Lonnemo ..... F04B 49/002 91/497
4,707,988 A * 11/1987 Palmers ..... F03G 3/08 60/413
(Continued)

FOREIGN PATENT DOCUMENTS

DE 102008053766 A1 4/2010

*Primary Examiner* — Adam J Eiseman
*Assistant Examiner* — Bobby Yeonjin Kim
(74) *Attorney, Agent, or Firm* — Workman Nydegger

(57) ABSTRACT

The present invention relates, in particular, to a forging hammer comprising a striker and a hydraulic linear drive that is coupled to the striker and is designed to drive the striker, which drive comprises a hydraulic circuit having a servo-motor hydro pump, a hydraulic cylinder, in particular a differential cylinder, which is fluidically connected downstream of the hydro pump via a directional valve module, and a servo-motor hydro generator, which is fluidically connected downstream of the hydraulic cylinder via the directional valve module, and comprising in addition a control unit configured at least for the simultaneous control of the hydro pump, the hydro generator and the directional valve module.

18 Claims, 5 Drawing Sheets

(51) Int. Cl.

| | |
|---|---|
| ***B21J 9/20*** | (2006.01) |
| ***B21J 11/00*** | (2006.01) |
| ***B21J 7/46*** | (2006.01) |
| ***B21J 9/12*** | (2006.01) |

(58) Field of Classification Search

CPC ... B30B 9/3057; B21J 7/28; B21J 7/40; F15B 1/024; F15B 21/14

USPC ..... 72/453.02, 453.06, 453.08, 453.12, 72/453.18; 100/269.01, 269.05, 269.14, 100/269.16

See application file for complete search history.

(56) References Cited

U.S. PATENT DOCUMENTS

| | | | | | |
|---|---|---|---|---|---|
| 4,890,475 | A * | 1/1990 | Baltschun | B21D 28/20 | 100/214 |
| 5,568,766 | A * | 10/1996 | Otremba | B30B 15/161 | 100/258 R |
| 8,677,799 | B2 * | 3/2014 | Jamet | B30B 15/16 | 100/269.08 |
| 2014/0318390 | A1 * | 10/2014 | Bauersachs | B30B 1/32 | 100/35 |

* cited by examiner

FORMING MACHINE, IN PARTICULAR FORGING HAMMER, AND METHOD FOR CONTROLLING A FORMING MACHINE

CROSS-REFERENCE TO RELATED APPLICATIONS

The present invention is a 35 U.S.C. § 371 U.S. National Stage Application corresponding to PCT Application no. PCT/EP2016/055950, filed on Mar. 18, 2016, which claims the benefit of priority to German Patent Application No. 102015105400.0 filed Apr. 9, 2015, the entire content of each of the aforementioned patent applications is incorporated herein by reference.

BACKGROUND OF THE INVENTION

1. Field of the Invention

2. Background

The underlying invention relates to a forming machine, in particular a forging hammer, and to a method for controlling a respective forming machine.

Various concepts of drives for driving forming machines such as forging hammers are known. It is known from DE 20 2014 104 509 U1, for example, that forging hammers can be operated by electric linear motors.

DE 20 2014 104 509 U1 furthermore describes that forging hammers can be operated by hydraulic linear motors, that is to say hydraulic cylinders. A pressure accumulator can be used for feeding the hydraulic cylinder with hydraulic fluid, as is the case in DE 20 2014 104 509 U1.

EP 0 116 024 B1 in the context of hydraulic machines describes the use of a pressure accumulator and of a hydraulic motor for operating hydraulic cylinders. EP 0 116 024 B1 furthermore describes that elastic energy that in the operation of hydraulic machines is stored in the hydraulic system and can be converted to electric energy by a hydraulic generator which in terms of fluid technology is switched in parallel with the hydraulic pump, wherein the hydraulic generator for generating the electric energy is connected to the hydraulic circuit.

The forming machines known, in particular the forging hammers, indeed offer room for improvement and variations in terms of the drive, the energy efficiency, and operating speeds that can be reached.

BRIEF SUMMARY OF THE INVENTION

To this extent, an object of the present invention can be seen in refining and/or improving the known forming machines in particular in terms of the drive, the energy efficiency, and/or the operating speeds that can be reached.

This object is achieved according to the invention in particular by design embodiments corresponding to the features as claimed in patent claims 1, 8, and/or 15. Further design embodiments, refinements, and variants are derived in particular from the dependent claims and from the description hereunder of exemplary embodiments.

As per one design embodiment according to patent claim 1, a forming machine which can particularly or preferably be a forging hammer, is provided. The forming machine in a corresponding manner is specified or configured, respectively, for machining workpieces by forming, in particular forging.

The forming machine according to the design embodiment of patent claim 1 comprises a striking tool, for example an upper die, a lower die, and/or a ram, which can be configured as a forming tool per se, for example, or can comprise a forming tool, and/or have an interface for receiving, in particular fastening, a forming tool.

The forming machine furthermore comprises a hydraulic linear drive which is configured for driving the striking tool and for the purpose of driving the striking tool is coupled to the latter. A hydraulic linear drive in the context of this application is to be understood to be drives which are configured in particular for converting hydraulic energy to kinetic energy of a linear movement. For example, the hydraulic linear drive can comprise a hydraulic cylinder that is driven by a hydraulic fluid and acts as a linear motor. In the case of one solution that is proposed herein a differential cylinder is proposed as the hydraulic cylinder; said differential cylinder can have a piston that is guided in a cylinder tube and has a piston rod that extends from said piston on one side and to which the striking tool, in particular the ram, can be secured, for example. It is to be noted at this point that the invention can also be applied to any hydraulic cylinders.

A fluid chamber that is configured on a side of the piston of the hydraulic cylinder that faces away from the piston rod or that is configured in operating states, is usually and in particular in the context of the underlying invention referred to as the piston chamber. A second fluid chamber that in an operating state of the hydraulic cylinder, in particular of the differential cylinder, is configured between the piston and the cylinder tube and through which the piston rod extends, or through which the piston rod can extend, is usually and in the context of the underlying invention referred to as the annular chamber.

The hydraulic linear drive comprises a hydraulic circuit having a servomotor-assisted hydro pump, that is to say a hydraulic pump which for the operation thereof is coupled to a motively driven servomotor. The servomotor-assisted hydro pump is specified in such a manner that the rotational speed of the pump, or the output of the pump, respectively, can be controlled by the servomotor.

The servomotor-assisted hydro pump while using the multi-way valve assembly proposed herein can be specified as a unidirectional servomotor-assisted hydro pump and be integrated in the hydraulic circuit. The term unidirectional in terms of the hydro pump is to be understood in particular to mean that hydraulic fluid in the operation of the forming machine at all times flows through the pump in the same flow direction, or that the hydro pump in one or a plurality of successive operating cycles of the hydraulic cylinder, in particular of the differential cylinder, is in each case operated in the same pumping direction or rotating direction. The unidirectional flow direction or pumping direction, respectively, can be defined in particular by a flow direction from an in particular central hydraulic tank to the hydraulic cylinder, in particular to the differential cylinder, in particular to the piston chamber or to the annular chamber of the differential cylinder.

Advantageous valve timings for the volumetric flows that are made available to the hydraulic system, or that are required by the hydraulic system, respectively, can be achieved in particular by a hydro pump that is unidirectional in terms of fluid technology.

The hydraulic pump can in particular be a constant displacement pump, that is to say a hydraulic pump having a constant volumetric displacement.

On account of the servomotor-assisted hydro pump proposed herein, the volumetric flow and/or the pressure of the hydraulic fluid in the hydraulic circuit can be adapted and correspondingly set in a comparatively precise and rapid manner to the respective requirements. The latter is of a decisive advantage in particular in the context for the comparatively high piston velocities and piston accelerations that arise in the case of forging hammers. In particular, the rotational speed of the pump or the hydraulic output of the hydro pump, while adhering to comparatively short valve timings, can be adapted in an optimal manner to the successive movement phases during one forging cycle and set so as to correspond to the respective requirements.

Furthermore, the motion profile of the piston, for example the speed, in particular the terminal speed that is reached directly prior to the ram or tool impacting a workpiece, can be set or controlled, respectively, in a comparatively precise manner by controlling the hydraulic circuit in a correspondingly accurate and temporally precise manner. This ultimately has an advantageous effect on the achievable forging or forming result and an energy-efficient operation can be achieved in an advantageous manner.

The hydraulic pump of the hydraulic linear gear in particular in the case of forging hammers can be conceived for comparatively high volumetric flows of, for example, 100 l/min to 500 l/min or more. In particular, a plurality of hydraulic pumps that are switched in parallel in terms of fluid technology can be used in the case of even greater volumetric flows. A pressure range in which the hydraulic pumps operate, that is to say a hydraulic pump pressure, can be in the range between 190 to 220 bar.

As has already been mentioned, the hydraulic linear gear comprises a hydraulic cylinder that is hydraulically operated or is hydraulically operable, in particular a differential cylinder, in particular a dual-action hydraulic cylinder having a piston rod that extends unilaterally from the piston. The hydraulic cylinder, in particular the differential cylinder, or in general terms the hydraulic linear motor, in terms of fluid technology is connected to a multi-way valve assembly, that is to say a functional assembly comprising at least one in particular directly controlled or pilot-controlled multi-way valve, and by way of the multi-way valve assembly of the hydro pump in terms of fluid technology is disposed so as to be downstream. This means that the hydraulic cylinder, in particular the differential cylinder, when in operation can be impinged with hydraulic fluid by way of the hydro pump.

Connected by way of the multi-way valve assembly is to mean in particular that the/a first fluid chamber, for example the piston chamber of the differential cylinder, in one switched position of a (multi-way) valve or of a (multi-way) valve assembly can be supplied or impinged with hydraulic fluid, in another switched position can be separated from the differential cylinder, and/or in yet another switched position in terms of fluid technology can be switched to a second fluid chamber, for example to the annular chamber of the differential cylinder. It is to be stated in particular that the multi-way valve assembly can have two, for example precisely two, switched positions, wherein in a first switched position the hydro pump is connected to the first fluid chamber, in particular the piston chamber, and in a second switched position is connected to the second fluid chamber, in particular the annular chamber of the differential cylinder. Further, or more detailed, respectively, explanations pertaining to the switching plan are derived from embodiments that are described further below.

The hydraulic circuit furthermore comprises a servomotor-assisted hydro generator, that is to say a hydro motor that is coupled to a servomotor that operates in a generative manner. The hydro generator can be conceived for volumetric flows in the range of 300 l/min, for example. A plurality of hydro generators or hydro motors, respectively, that in terms of fluid technology are switched in parallel can be used in the case of higher volumetric flows.

In particular, the servomotor-assisted hydro generator is configured and within the hydraulic circuit is switched in such a manner that said hydro generator when impinged with hydraulic fluid in the orderly operation of the forming machine operates in a generative manner, that is to say generates electric energy from hydraulic energy. The hydro motor herein from hydraulic energy can generate mechanical energy for driving the generatively operating servomotor, that is to say the servo generator, wherein the servo generator can convert the mechanical energy to electrical energy.

The servomotor-assisted hydro generator while using the multi-way valve assembly proposed herein can be specified and integrated in the hydraulic circuit as a unidirectional servomotor-assisted hydro generator. Reference is made to the explanations above pertaining to the term unidirectional. In particular, in terms of the hydro generator, unidirectional is to be understood to mean that hydraulic fluid in the operation of the forming machine at all times flows through the hydro motor in the same flow direction, or that the hydro motor in one or a plurality of successive operating cycles of the hydraulic cylinder, in particular of the differential cylinder, is in each case operated in the same direction of rotation or flow direction of the hydraulic fluid, respectively. The unidirectional flow direction or direction of rotation, respectively, can be defined in particular by a flow direction from the hydraulic cylinder, in particular the differential cylinder, in particular the piston chamber, or annular chamber, to a, for example central, hydraulic tank of the hydraulic system.

It is provided that the hydro generator in terms of fluid technology by way of the multi-way valve assembly is downstream of the hydraulic cylinder, in particular the differential cylinder. Overall, fluid-technological switching plans of the hydro pump, the hydraulic cylinder, in particular the differential cylinder, and the hydro generator in which the hydro pump, the differential cylinder, and the hydro generator during one operating cycle of the hydraulic cylinder, in particular of the differential cylinder, are substantially at all times, or during one or a plurality of pre-defined temporal portions switched in series, can thus be achieved, this being intended to mean that hydraulic fluid that flows into a fluid chamber of the hydraulic cylinder, in particular of the differential cylinder, is at all times provided by the hydro pump, and hydraulic fluid that flows from the hydraulic cylinder, in particular from the differential cylinder, is at all times discharged by way of the hydro generator.

By using and incorporating the servomotor-assisted hydro generator it is possible for hydraulic energy to be scavenged from the hydraulic fluid that flows from the hydraulic cylinder, in particular from the differential cylinder, in a manner corresponding to the respective actuation of the generatively operating servomotor of the hydro generator. In particular, the hydro generator, by correspondingly regulating the torque of the generatively operating servomotor, can be operated as a hydraulic brake for the piston of the hydraulic cylinder, in particular of the differential cylinder. It is possible in particular for the piston and thus the striking tool to be actively decelerated.

By way of the arrangement and of the hydraulic switching plan of the hydro motor and of the hydro generator proposed herein it is thus possible for the piston by being controlled in a corresponding manner to be actively accelerated and actively decelerated at substantially any point in time during the operating cycle without a reversal in terms of control, that is to say a reversal of the direction of rotation of the hydro pump or of the hydro generator, being required. In particular the latter has an advantageous effect on the energy efficiency and the achievable accuracy and speed in terms of control, and can ultimately also lead to improvements in the forming quality.

Apart from the hydro generator being able to be employed as an active hydraulic brake for the piston, the hydro generator can also be used for recovering energy in that excess elastic energy is scavenged from the hydraulic system by way of controlling the hydro generator in a corresponding manner.

The forming machine furthermore comprises at least one control unit that is conceived and configured for controlling at least the hydro pump, the hydro generator, and the multi-way valve assembly in particular at least in portions or in a temporally overlapping simultaneous manner.

In particular, it is possible by way of a corresponding actuation of the multi-way valve assembly by means of the control unit for the hydro pump, the hydro generator, and the multi-way valve assembly to be switched in series during an entire operating cycle of the differential cylinder, or at least during a substantial part of the operating cycle, such that a defined and comparatively precise motion control of the hydraulic cylinder, in particular of the differential cylinder, can be achieved by coupling in terms of hydraulics of the hydraulic cylinder, in particular of the differential cylinder, to the hydro pump. Simultaneously therewith, or in parallel therewith, respectively, in particular across the entire operating cycle, elastic or hydraulic energy that has been accumulated or generated in the hydraulic system, or in the hydraulic circuit respectively, can be converted to electric energy by controlling the hydro generator in a corresponding manner.

A simultaneous operation of the hydro pump and of the hydro generator can be demonstratively implemented by the fluid-technological switching plan proposed herein for the hydro pump, the hydraulic cylinder, in particular the differential cylinder, and the hydro generator, this having advantageous effects on the precision of control and the energy efficiency of the forming machine.

A substantially continuous motion control across the entire operating cycle can be achieved in particular in the case of forging hammers having comparatively high speeds of, for example, 2 m/s to 5 m/s, and comparatively high accelerations on the striking tool by the hydro pump and the hydro generator proposed herein, and by the hydraulic switching plan proposed herein of the hydro pump and of the hydro generator, this being of a decisive advantage for precise forging results, while a comparatively energy-efficient operation in comparison to conventional forging hammers is simultaneously possible.

The control unit in design embodiments can be specified in such a manner that the multi-way valve assembly is actuated such, or the switched position of the multi-way valve assembly is set such, respectively, at least at times during an operating movement or an operating cycle of the hydraulic cylinder, in particular of the differential cylinder, that the hydro pump in terms of fluid technology is connected to the first fluid chamber of the hydraulic cylinder, in particular to the piston chamber, and the hydro generator in terms of fluid technology is connected to a second fluid chamber of the hydraulic cylinder, in particular to the annular chamber of the differential cylinder. Reference is made to the explanations above pertaining to the terms piston chamber and annular chamber, said explanations applying in an analogous manner.

The control unit can furthermore be specified such that the multi-way valve assembly at least at times during a return movement, that is to say during a movement that is counter to the operating movement, of the hydraulic cylinder, in particular of the differential cylinder, is actuated such that the hydro pump in terms of fluid technology is connected to the second fluid chamber of the hydraulic cylinder, in particular to the annular chamber, and the hydro generator in terms of fluid technology is connected to the first fluid chamber of the hydraulic cylinder, in particular to the piston chamber of the differential cylinder.

In particular, the control unit can be specified in such a manner that said control unit controls the multi-way valve assembly in such a manner that the hydro pump in sequentially successive, in particular directly successive, portions of an operating cycle of the differential cylinder is to be or is, respectively, connected alternatingly to a first fluid chamber, in particular to the piston chamber, and to a second fluid chamber, in particular the annular chamber. Accordingly, the hydro generator in a corresponding manner can be connected alternatingly to the second fluid chamber, in particular to the annular chamber, and to the first fluid chamber, in particular to the piston chamber.

The hydraulic cylinder, in particular the differential cylinder, and in particular the striking tool, in particular by way of a control of this type and of an alternating switching plan of the hydro pump and of the hydro generator can be operated in a manner combined with energy recovery by way of the hydraulic generator so as to have motion control that is performed continuously between the reversal points of the hydraulic cylinder, in particular of the differential cylinder, and in particular also in the region of the reversal points.

The multi-way valve assembly in design embodiments can comprise a 4/2-way valve.

The multi-way valve assembly in design embodiments can comprise in particular four individual hydraulic valves which in terms of fluid technology are interconnected by a bridge layout. A bridge layout can be understood in particular as a polygonal layout of, for example, four hydraulic valves having interdisposed connection points. Such a bridge layout can be implemented as a parallel layout of in each case two hydraulic valves switched in series, for example.

The hydraulic circuit in design embodiments can comprise at least one suction valve which in terms of fluid technology is connected to a suction source, for example to a hydraulic fluid reservoir, container, or tank, on the one hand, and to at least one fluid chamber, in particular to the piston chamber and/or the annular chamber of the differential cylinder, on the other hand.

In particular, the linkage of the suction valve in terms of fluid technology can be configured in such a manner that a negative pressure that is created in the at least one fluid chamber in the operation of the hydraulic cylinder, in particular of the differential cylinder, is equalizable by suctioning hydraulic fluid by way of the suction valve. Corresponding negative pressures in the case of a forging hammer can arise in the annular chamber in the case of a rebound of the striking tool, and/or when the volumetric enlargement of the piston chamber in an operating state is larger than the volume of hydraulic fluid that is provided by the hydro pump. The latter can arise, for example, when the volumetric flow that is generated by the hydro pump lags behind, or is smaller or becomes smaller, respectively, than the volumetric variation of the piston chamber that is caused by the enlargement of the piston chamber, which can be the case, for example, in the initial acceleration of the piston in the direction of the workpiece in order for the respective required speed of the striking tool to be tuned.

DETAILED DESCRIPTION OF THE PREFERRED EMBODIMENTS

The suction valve can be a hydraulic valve that is configured in the manner of a non-return valve for example, in particular a unilaterally blocking automatic valve. The suction valve can be conceived for volumetric flows of the magnitude between 150 l/min to 10,000 l/min, for example. The respective conception of the suction valve depends inter alia on the respective cubic capacity and on the piston speeds that arise in each case.

The control unit in embodiments can be specified for controlling the rotational speed of the pump of the hydro pump in such a manner that the hydraulic pump during the operation, in particular during one or a plurality of successive operating cycles, is at all times operated at least at a minimum rotational speed that is that is unequal to zero. This is to mean in particular that the hydraulic pump is actuated in such a manner that the rotational speed of the pump is not below a limit value that is unequal to zero. This can be achieved in particular by the hydraulic switching plan proposed herein of the components of the hydraulic circuit in combination with the use of a servomotor-assisted hydro pump proposed herein.

The control unit in design embodiments can be configured and specified in such a manner that said control unit controls, or can control, respectively, the hydro pump in such a manner that the latter during the operation, in particular during an operating portion of one or a plurality of operating cycles of the hydraulic cylinder, in particular of the differential cylinder, is operated at least at a minimum rotational speed that is unequal to zero.

In particular, the control unit can be specified in such a manner that the hydraulic pump during one or a plurality of directly successive operating cycles is at all times operated at least at the minimum rotational speed. This means in particular that the minimum rotational speed in a respective operating mode represents the lower limit for the rotational speed of the hydro pump. The hydraulic pump in the case of a respective operation is thus not completely stopped but is conjointly operated in a continuous manner which can entail advantages in terms of energy efficiency and accuracy of the speed setting, in particular of the terminal speed, of the forging tool.

The control unit in design embodiments can be specified in such a manner that the hydraulic pump initially is or is to be, respectively, activated at the minimum rotational speed, and subsequently the rotational speed of the pump in an operating range of an operating cycle of the hydraulic cylinder, in particular of the differential cylinder, initially is increased from the minimum rotational speed to a maximum rotational speed. In a subsequent operating portion the rotational speed of the pump can be decreased from the maximum rotational speed to the minimum rotational speed, in particular in such a manner that the minimum rotational speed is reached or is present at a reversal point of the hydraulic cylinder, in particular of the differential cylinder. The reversal point is preferably that reversal point of the piston of the hydraulic cylinder, in particular of the differential cylinder, that faces the effective range of the striking tool.

According to design embodiments, the increase in the rotational speed of the pump of the hydro pump, or the reduction in the speed of the rotational speed of the pump of the hydro pump, respectively, can be performed so as to correspond to a linear function of time. In particular, the control unit in design embodiments can be specified in such a manner that the maximum rotational speed is, or is to be, respectively, reached ahead of or at the point in time of the striking tool impacting a workpiece that is positioned in the operating region.

In order for a pre-defined terminal speed of the striking tool to be reached, it can be provided in design embodiments that the rotational speed of the pump of the hydraulic pump is decreased when reaching the maximum rotational speed such that the maximum rotational speed or a pre-defined terminal speed under the influence of the hydraulic forces prevalent in the hydraulic circuit and optionally under the force of gravity that acts on the striking tool is reached at or shortly or directly ahead of the reversal point or forming point, or at or shortly or directly ahead of the reversal point of the forming point. In order for the terminal speed to be set, the hydro generator can also be operated as a hydraulic brake so as to actively decelerate the piston.

It is derived from the explanations above in particular that by way of controlling the hydro pump and the hydro generator in a corresponding manner, the motion sequence, in particular the terminal speed, of the hydraulic cylinder, in particular of the differential cylinder, and thus of the striking tool can be varied and accurately set in a comparatively flexible manner within the limits determined by the overall construction of the forming machine. In particular, a comparatively accurate and reliable setting of the impact speed, or of the terminal speed of the striking tool, respectively, can be achieved by controlling the rotational speed of the pump of the hydro pump in a suitable manner, optionally by additionally using suitable sensors for measuring the position and/or the speed of the hydraulic cylinder, in particular of the differential cylinder, or of the striking tool, and/or sensors for measuring one or a plurality of pressures prevalent in the hydraulic system.

In a manner corresponding to the explanations above, the forming machine can have sensors interacting with the control unit, for example, said sensors being configured for determining the position of the hydraulic cylinder, in particular of the differential cylinder, and/or of the striking tool. Furthermore, sensors for measuring the pressure in the hydraulic circuit, for example in a line that opens into the first fluid chamber, in particular into the piston chamber, and/or in a line that opens into the second fluid chamber, in particular into the annular chamber, can be attached. The sensors can be coupled to the control unit such that values pertaining to pressures and/or to position of the striking tool or of the hydraulic cylinder, in particular of the differential cylinder, that are transmitted by the sensors to the control unit can be used for controlling the hydro pump and/or the hydro generator. The pressure data and/or the position data are preferably processed by the control unit and used for controlling the hydro pump and/or the hydro generator in such a manner that the striking tool has the respective terminal speed required at the, or shortly before, or directly ahead of, the impact point.

It can be provided in design embodiments that during a return movement, that is during an operating movement of the hydraulic cylinder, in particular of the differential cylinder, that is counter to the aforementioned operating movement, that is to say during a movement portion in which the hydraulic cylinder, in particular the differential cylinder, or the striking tool, respectively, upon completion of forming moves away from the workpiece, the hydro pump is operated at the minimum rotational speed, that is to say that the rotational speed of the pump of the hydro pump in this operating portion is, or will be, respectively, set to the minimum rotational speed. The operation at the minimum rotational speed can be used in particular for accelerating the ram and, in the case of a downstroke forming machine, for driving the ram upward.

It can be provided in further design embodiments that the control unit is connected to sensors for measuring the speed of the hydraulic cylinder, in particular of the differential cylinder, or of the striking tool, respectively, that means that the forming machine can comprise respective speed sensors, and speed data that have been determined are used by the control unit for controlling or regulating, respectively, the hydro pump and/or the hydro generator in order for the terminal speed to be tuned to a pre-defined value.

It is possible, for example, for the terminal speed of the striking tool in the impact point to have the respective required value in particular while using the sensors proposed herein in combination with the servo-controlled components herein, that is to say the hydro pump and the hydro generator. For example, different terminal speeds can be set in successive operating cycles without any substantially great complexity.

It can be provided in design embodiments that an initial point for starting a forming or forging procedure, in particular an initial point from which the piston or the ram is accelerated in the direction of the forming region, is set so as to depend on the respective terminal speed desired, required, or pre-defined, in a manner corresponding to the respective energy, in particular forming energy, desired, required, or pre-defined, respectively, depending on the height of the workpiece to be formed, measured in the movement direction of the piston, and/or depending on the respective forming path, in a manner corresponding to the compression or forming of the workpiece, for example, parallel with the movement direction of the piston.

The initial point from which the acceleration of the ram is performed can be in particular a reversal point that faces away from the forming region, in the case of a downstroke forming machine an upper dead center of the piston or of the ram, for example.

A variable setting of the initial point, or of the initial stroke, from which the acceleration of the piston or of the striking tool, ram, or die, respectively, is performed, as has been described above in particular and is possible in design embodiments, enables in particular an optimal setting of the motion sequence of the piston or of the ram, etc., respectively. It is furthermore possible for the stroke of the piston, for example the upper dead center of the latter, to be set in a variable manner such that improved forming or forging cycles, or forming or forging frequencies, can be achieved, for example.

It is possible in particular in design embodiments that the control unit is conceived in such a manner that the path that is traveled by the striking tool during one forging cycle, or the corresponding strokes, respectively, is/are minimal. For example, the control unit can be conceived and specified in such a manner that different strokes can be implemented, for example a minimum stroke required for achieving a desired or pre-defined terminal speed or forming energy that is temporally subsequent in the forming operation, by approaching in a targeted manner different reversal points, for example an upper dead center of the piston.

By using variable strokes of the piston it is possible in particular for forming times to be optimized, and for the motion sequence to be optimized depending on the respective desired terminal speed, forming energy, depending on the height of the workpiece to be formed, measured in the movement direction of the piston, and/or depending on the respective forming path, in a manner corresponding to the compression or forming of the workpiece, for example, parallel with the movement direction.

The control unit in design embodiments can be specified and configured for determining a further initial point, in particular an upper dead center, of a successive, preferably a directly successive forming cycle, by means of an initial point, in particular of an upper dead center, of a preceding forming cycle, for example of a starting point of the piston or of the ram or of the die at the commencement of a preceding forming cycle, in particular a directly preceding forming cycle.

The control unit, based on the the first control data for controlling the movements of, for example, the piston, the ram, or the die, of a first forming procedure, can be conceived in particular for determining second control data for controlling the movements of, for example, the piston, the ram, or the die, of a second forming procedure. The second forming procedure herein can follow directly after the first forming procedure. Optimized forming times can advantageously be achieved by controlling the forming procedures, in particular successive forming procedures, in such a manner. The second control data can be determined based on the first control data and determined from the first control data based on the parameters pre-defined for the temporally successive forming procedure.

It can be provided in design embodiments, for example, that a striking energy, for example a forming energy, of a last-performed stroke is used for the starting position of the piston to be calculated, in particular automatically determined, by the control unit or the controller, based on a subsequently required striking energy. The starting position can be set so as to depend on the respective height of the workpiece to be formed.

It can be provided in design embodiments that the position, in particular the initial position, of the piston or of the ram or of the die, at the commencement or at a defined point in time during a forming or forging cycle, is determined and/or used as a calculation basis for determining an initial position of the piston, of the ram, or of the die, and/or of operating parameters for controlling the movements of the piston, of the ram, and/or of the die during or for a temporally subsequent forming or forging procedure.

The control unit in design embodiments can be specified and configured in such a manner that said control unit controls or can control, respectively, the hydraulic pump such that a maximum advancing speed of the hydraulic cylinder, in particular of the differential cylinder, or of the striking tool, is in the range between 1.5 m/s and 6 m/s, in particular at approximately 1.5 m/s or 5 m/s, or between 4.8 m/s and 5.5 m/s, and that preferably a maximum return speed of the hydraulic cylinder, in particular of the differential cylinder, is in the range between 1.5 m/s and 2.5 m/s, preferably at 2 m/s, in particular between 1.8 m/s and 2.1 m/s.

It can be provided in design embodiments that the volumetric flow in the case of deceleration procedures in the one or the other direction of movement of the piston, that is to say in the case of the forward or rearward movement of the piston, in the case of a downstroke forming machine in the case of an upward and downward movement of the piston, is approximately identical. However, the volumetric flow can vary depending on the piston diameter, the rod diameter, the piston speed, and other issues, or can be set so as to depend on these variables. The recovery of energy by means of the hydro generator can be optimized and an overall energy-saving operation can be achieved in particular when approximately identical conditions prevail in the reciprocating movement.

The forming machine in design embodiments can furthermore comprise an energy accumulator which for the purpose of feeding electrical energy that is generated by the hydro generator is connected to the hydro generator. In this way, the electric energy that is generated by the hydro generator, or that is generated by the hydro generator from the hydraulic energy of the hydraulic circuit, respectively, can be temporarily stored and be made available again to the forming machine in a subsequent operating cycle or operating portion, for example in order for the hydro pump to be operated. Apart therefrom, it is also possible for the electric energy that is generated by the hydro generator to be fed to an electric grid that is connected to the forming machine, or to a combined heat and power network.

Particularly accurate and precise controlling of the forming machine, in particular of the hydraulic cylinder, in particular of the differential cylinder, or of the striking tool, respectively, of the forming machine will be or is, respectively, demonstratively enabled by the specific combination proposed herein of the hydraulic components proposed herein, in particular of the hydro motor, the hydro generator, and the multi-way valve assembly, and the switching plan thereof, wherein a comparatively energy-efficient operation of the forming machine is simultaneously enabled by a hydraulic circuit as is proposed herein.

A method for controlling an operating cycle of a forming machine is provided as claimed in patent claim 8. In particular, the forming machine can be a striking forming machine such as, for example, a forging hammer.

In the method proposed herein it is provided that a hydraulic cylinder, in particular a differential cylinder, that is coupled to a striking tool is driven by the supply of hydraulic fluid by way of a servomotor-assisted hydro pump of a hydraulic linear drive, said hydro pump in terms of fluid technology being coupled to a hydraulic circuit, and by way of a multi-way valve assembly that in terms of fluid technology is disposed upstream of said hydraulic cylinder. In particular, driving of the hydraulic cylinder can be performed by impinging a fluid chamber, in particular the piston chamber, or the annular chamber, respectively, of the differential cylinder.

It can be provided in particular that in particular when the hydro pump in terms of fluid technology is connected to a fluid chamber of the hydraulic cylinder, for example to the piston chamber or the fluid chamber, of the differential cylinder, hydraulic fluid that flows from a further fluid chamber of the hydraulic cylinder, in particular of the differential cylinder, for example that flows from the second fluid chamber, in particular from the annular chamber, or from the first fluid chamber, in particular from the piston chamber, by way of the multi-way valve assembly is directed into a servomotor-assisted hydro generator that in terms of fluid technology in the hydraulic circuit is disposed downstream of the multi-way valve assembly.

This is to mean in particular that the hydro pump in terms of fluid technology is coupled to a fluid chamber and the hydro generator herein, at least in a portion of the operating cycle, in particular simultaneously, is coupled to the further fluid chamber.

Dual controlling of the hydraulic circuit is possible herein at least in those portions in which both fluid chambers are coupled, in particular in terms of fluid technology are connected, to the hydro pump or to the hydro generator, which is to mean that the hydraulic circuit can be influenced or is capable of being influenced in particular by the simultaneous actuation of the hydro pump and the hydro generator.

The hydraulic cylinder, in particular the differential cylinder, can be controlled in a comparatively accurate and reliable manner in particular as a result of the potential for dual controlling of the hydraulic circuit by way of the hydro pump, on the one hand, and by way of the hydro generator, on the other hand, on account of which improved forging results can be obtained in particular.

It can be achieved in particular in this way that the hydro motor and the hydro generator can be operated separately or simultaneously during the entire operating cycle of the hydraulic cylinder, in particular of the differential cylinder, on account of which comparatively precise controlling of the hydraulic cylinder, in particular of the differential cylinder, can be achieved at a simultaneously energy-efficient operation. In terms of further advantages and advantageous effects, reference is made to the explanations above which apply in an analogous manner.

It can be provided in design embodiments that during an operating movement, in particular an advancing movement in the direction of the operating region or the forming region of the hydraulic cylinder, in particular of the differential cylinder, the multi-way valve assembly is actuated such that the hydro pump in terms of fluid technology is connected to the first fluid chamber, in particular to the piston chamber, and the hydro generator in terms of fluid technology is connected to the second fluid chamber, in particular to the annular chamber of the differential cylinder.

It can be provided in further design embodiments that that the multi-way valve assembly at least at times during a return movement of the hydraulic cylinder, in particular of the differential cylinder, that is to say during a movement of the hydraulic cylinder or of the striking tool that is directed away from the operating region or operating point of the hydraulic cylinder, in particular of the differential cylinder or of the striking tool, is or is to be actuated such that the hydro pump in terms of fluid technology is connected to the second fluid chamber, in particular to the annular chamber, and the hydro generator in terms of fluid technology is connected to the first annular chamber, in particular to the piston chamber, of the differential cylinder. In terms of advantages and advantageous effects, and/or of further details of the operating mode proposed herein, reference is made in particular also to the explanations above which apply in an analogous manner.

It can be provided in design embodiments that the hydro pump is controlled by the control unit in such a manner that the hydro pump during the operation is operated at a minimum rotational speed that is above zero, or at a minimum rotational speed that is at least not equal to zero, respectively.

In particular, the rotational speed of the pump in design embodiments in an operating portion of an operating cycle of the hydraulic cylinder, in particular of the differential cylinder, can initially be increased from the minimum rotational speed to a maximum rotational speed, and subsequently be decreased from the maximum rotational speed to the minimum rotational speed, for example in such a manner that the minimum rotational speed is reached or is present at a reversal point of the hydraulic cylinder, in particular of the differential cylinder, of the piston, that faces the operating region of the striking tool.

Controlling of the rotational speed of the pump can be performed, for example, as per a pre-defined function of time and/or the position of the hydraulic cylinder, in particular of the differential cylinder, for example so as to correspond to a linear correlation with time. However, controlling while using correlations which at least in part are not linear is also possible by way of the hydraulic system proposed herein.

The rotational speed of the pump in design embodiments can be set or tuned to the minimum rotational speed during a return portion of the operating cycle of the hydraulic cylinder, in particular of the differential cylinder.

It can be provided in design embodiments that in order for the hydraulic cylinder, in particular the differential cylinder, that is to say the piston of the hydraulic cylinder, in particular of the differential cylinder, to be accelerated in the direction of a first reversal point that is assigned to a forming region or operating region of the forming machine, that is to say a reversal point of the hydraulic cylinder or of the differential cylinder or of the striking tool, respectively, the rotational speed of the pump of the hydro pump is increased from the minimum rotational speed to the maximum rotational speed in such a manner, in particular in a linear correlation with time, that the maximum rotational speed is or is to be reached ahead of reaching a first reversal point of the hydraulic cylinder, in particular of the differential cylinder, that is assigned to the forming region.

It can furthermore be provided in design embodiments that controlling is performed in such a manner that the rotational speed of the pump of the hydro pump, that is to say the rotational speed of the hydraulic pump of the hydro pump, after reaching the maximum rotational speed is decreased in such a manner, in particular in a linear correlation with time, that the minimum rotational speed is reached or set as or when the first reversal point is reached. In terms of advantages or advantageous effects of respective design embodiments, reference is made to the explanations above.

It can be provided in design embodiments that so as to coincide with reaching the first reversal point that is assigned to the forming region of the forming machine, or when reaching the one pre-defined speed of the ram or of the piston, respectively, the multi-way valve assembly is actuated in such a manner that a pressure output of the hydro pump in terms of fluid technology is or is to be, respectively, connected to the second fluid chamber of the hydraulic cylinder, in particular to the annular chamber of the hydraulic cylinder, in particular of the differential cylinder, and a pressure input of the hydro generator in terms of fluid technology is or is to be, respectively, connected to the first fluid chamber of the hydraulic cylinder, in particular the piston chamber of the differential cylinder.

In particular in the case of such design embodiments, an elastic energy that is stored, generated, and/or created in the hydraulic system of the forming machine, in particular a potential energy that is stored in the hydraulic fluid, for example by decompression of the hydraulic fluid or of the hydraulic system, respectively, can be converted by way of the hydro generator to electrical energy or to another secondary form of energy, and can be supplied to the forming machine in subsequent operating cycles, for example. In this context, reference is made additionally to the explanations further above which apply in an analogous manner.

It can be provided in design embodiments that a negative pressure in the second fluid chamber, in particular in the annular chamber, that is created by a rebound of the hydraulic cylinder, in particular of the differential cylinder or of the striking tool, respectively, at the first reversal point is equalized by at least a suction valve that in terms of fluid technology is connected to the second fluid chamber, on the one hand, and to a hydraulic container, on the other hand. It can be furthermore provided that a positive pressure in the first fluid chamber, in particular in the piston chamber, that is created by the rebound, or an elastic energy that is created by decompression in the hydraulic circuit, respectively, is converted by way of, or by the hydro generator, respectively, to a second form of energy, for example electric energy, and is preferably stored in an intermediate accumulator. In terms of advantages and advantageous effects, reference is made in particular to the explanations further above and to the explanations further below, said explanations applying in an analogous manner.

It can be provided in design embodiments that so as to coincide with reaching a second reversal point, or when or directly ahead of reaching said second reversal point of the hydraulic cylinder, in particular of the differential cylinder, that faces away from the forming region of the forming machine, the multi-way valve assembly is actuated in such a manner that a pressure output of the hydro pump in terms of fluid technology is or is to be connected to the first fluid chamber, in particular to the piston chamber, and a pressure input of the hydro generator in terms of fluid technology is or is to be connected to the second fluid chamber, in particular to the annular chamber of the differential cylinder.

It can be provided in particular in design embodiments that pressure variations in the hydraulic system that optionally arise during a switching reversal of the pressure output of the hydro pump and of the pressure input of the hydro generator are equalized by one or a plurality of suction valves that are switched in a corresponding manner in the hydraulic circuit. In other words, suction valves can be provided in such a manner that any potential pressure variations in the hydraulic system can be equalized, in particular in order for pressure surges to be avoided.

It is advantageously provided in design embodiments that controlling of the movements of the piston, of the ram, and/or of the die is carried out by the control unit at or in the region of the two reversal points of the piston, except for the rebound that arises only at the forming reversal point, in approximately or substantially the same manner, respectively. This means in particular that, apart from the temporal period during which a rebound acts on the hydraulic system, motion control that is substantially identical can be applied at both reversal points, said motion control optionally being corrected in terms of gravity.

It can be provided in design embodiments that a plurality of successive operating cycles are controlled as per one of the design embodiments described above, wherein the hydro pump and the hydro generator during the operating cycles are operated continuously in the same direction of rotation, that is to say without any reversal of the direction of rotation, and/or wherein the hydro pump across the plurality of operating cycles is operated at least at the minimum rotational speed that is unequal to zero, and/or wherein secondary energy, for example electric energy, that is generated by the hydro generator in one operating cycle and/or a partial operating cycle in a subsequent operating cycle and/or partial operating cycle is supplied to the forming machine, in particular to the hydro pump. An advantageous energy efficiency can be achieved in particular in this way.

In particular, it becomes clear from the above and preceding explanations that the object on which the invention is based is achieved by the forming machine proposed herein and by the method proposed herein for controlling the forming machine.

Exemplary embodiments of the invention will be described in more detail hereunder by means of the appended figures in which:

FIG. 1 shows a schematic illustration of the construction of a downstroke forging hammer 1 that is configured according to one design embodiment of the invention.

Figure 1:
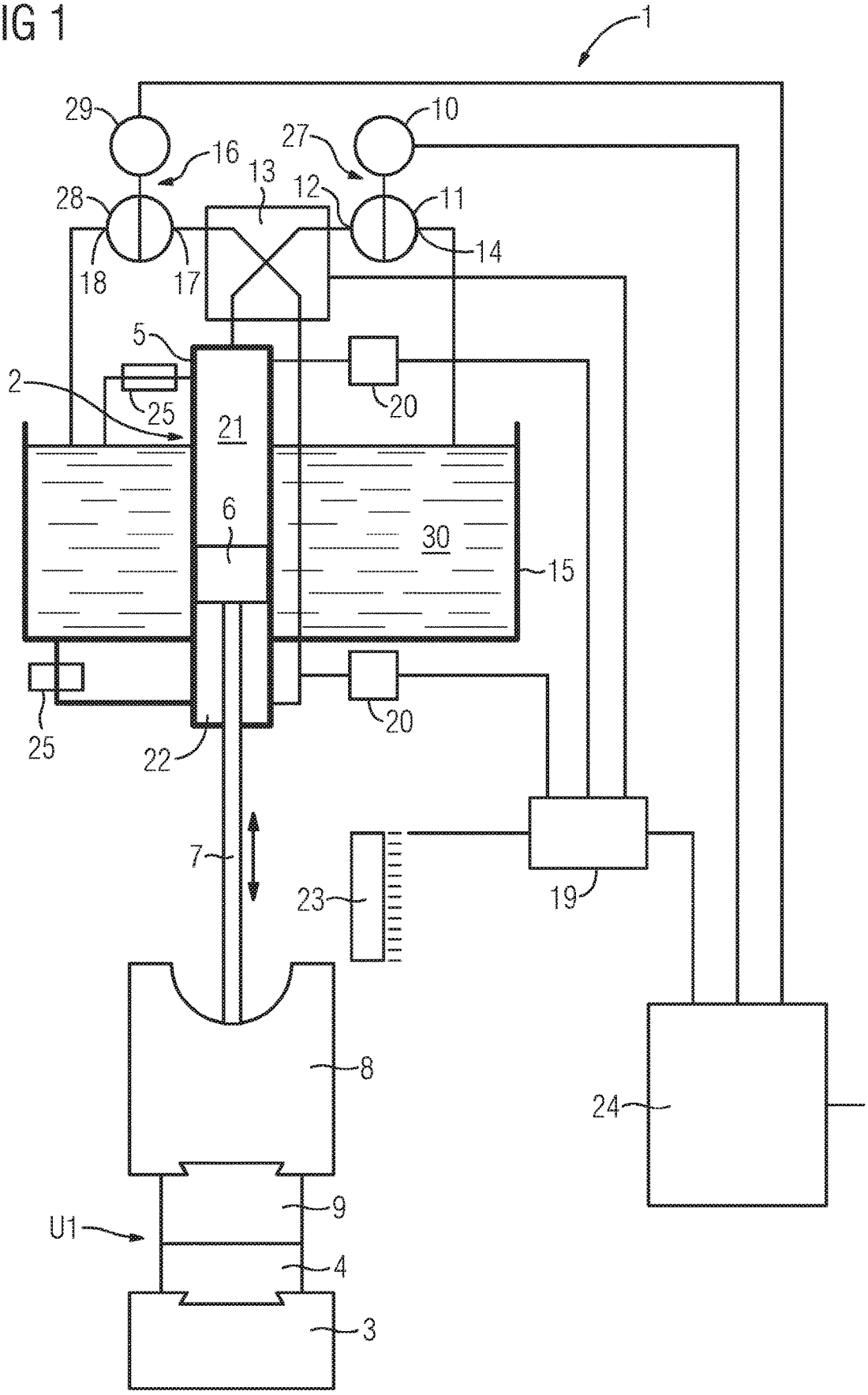
FIG. 1 shows a schematic illustration of the construction of a forging hammer that is configured according to one design embodiment of the invention.

Components of the forging hammer 1 will be described in more detail hereunder by means of FIG. 1, wherein the functioning and the operating mode of the forging hammer 1 will be explained in more detail in particular in the context of FIGS. 2 to 5.

The forging hammer 1 comprises a frame (not illustrated) on which a differential cylinder 2 is secured. Furthermore, a lower die 3 having a lower tool 4 that is releasably attached to the former is fastened to the frame.

A piston rod 7 which extends unilaterally from the piston 6 is attached to the piston 6 which is guided so as to be longitudinally displaceable in a cylinder tube 5 of the differential cylinder 2.

An upper die which is configured as a ram 8, that is to say as a forging ram, is fastened to an end of the piston rod 7 that is remote from the piston 6, said upper die being able to be moved in the longitudinal direction of the cylinder tube 5, in a reciprocating manner so as to coincide with the piston 6.

The degree of freedom of movement of the piston 6, or of the ram 8, respectively, is schematically illustrated in FIG. 1 by means of a double arrow. The forging hammer 1 in the present case is configured as a vertical forging hammer, which is to mean that a movement of the ram 8, or of an upper tool 9 releasably attached to said ram 8, respectively, in the orderly operating state is performed in the vertical direction from top to bottom and vice versa.

The forging hammer 1 in the example of FIG. 1 is shown in an operating state in which the upper tool 9 bears on the lower tool 4, so as to correspond to a first reversal point U1 of the ram 8, or of the upper tool 9, respectively.

The forging hammer 1 has a hydraulic circuit that comprises the differential cylinder 2, said hydraulic circuit having one or, depending on requirements, a plurality of servomotor-assisted hydro pumps 27, the latter each comprising a hydraulic pump 11 that is controlled by way of a servomotor 10, the pressure side 12 of said hydraulic pump 11 in terms of fluid technology being connected to a 4/2-way valve 13, and the suction side 14 of said hydraulic pump 11 in terms of fluid technology being connected to a hydraulic tank 15.

The hydraulic circuit furthermore comprises a hydro generator 16, the input side 17 of the latter in terms of fluid technology being connected to the multi-way valve 13, and the output side 18 of said hydro generator 16 in terms of fluid technology being connected to the hydraulic tank 15.

The forming machine 1 furthermore comprises a control unit 19 which is configured and provided with corresponding control lines such that the components of the forging hammer 1, in particular the multi-way valve 13, the hydro pump 27, and the hydro generator 16, and optionally further components, can be controlled.

The control unit 19 can be designed so as to have various sensors for detecting operating parameters of the forging hammer 1. For example, the forging hammer 1 can have one or a plurality of pressure sensors 20 by way of which a pressure which is prevalent in a piston chamber 21 of the differential cylinder 2 and/or a pressure which is prevalent in an annular chamber 22 of the differential cylinder 2 can be detected in the operation of the forging hammer 1, for example, said detected pressure being able to be used, for example, by the control unit 19 for controlling the forging hammer 1, in particular the differential cylinder 2 and/or the hydro pump 27 and/or the hydro generator 16.

The hydro generator 16 comprises one or, depending on the requirements, a plurality of hydro motors 28 and a servo generator 29, that is to say a generatively operated servomotor, that in terms of drive technology is coupled to the hydro motor 28.

The hydro pump 27 and the hydro generator 16 can be controlled by means of the servomotor 10 and of the servo generator 29, and for this purpose are connected to the control unit 19 by way of respective control lines. In particular, the hydro pump 27 and the hydro generator can be controlled in terms of rotational speed and/or torque, for example in such a manner that setting and/or achieving a pre-defined or desired terminal speed of the ram 9 is achieved. In particular, the hydro pump 27 and the hydro generator 16 can be controlled such that the ram 9 or the piston 6 follows a pre-defined motion sequence, wherein hydro pump 27 and hydro generator 16 make available the hydraulic drive output or brake output that is required in each case.

The forging hammer 1 can furthermore comprise a position and/or speed sensor 23 by way of which a position and/or speed of the ram 8, or of the piston 6, respectively, can be determined by the control unit 19, wherein respective position and/or speed data can be used for controlling the hydraulic circuit, in particular the hydro pump 27 and/or the hydro generator 16 and/or the multi-way valve 13, for example for controlling or setting a respective desired terminal speed or impact speed of the differential cylinder 2.

The forging hammer 1 shown in the context of the figures furthermore comprises an energy accumulator 24 in which secondary energy, for example in the form of electric energy, that has been generated by the hydro generator 16, for example by converting hydraulic energy, in particular elastic energy, from the hydraulic circuit, can be stored. The energy accumulator 24 can be connected to the control unit 19 for controlling the charging and discharging of the former. In particular, the energy accumulator 24 and the associated controls can be mutually adapted such that energy that has been recovered from one or from a plurality of preceding operating cycles of the forging hammer 1 can be used or accessed for operating the forging hammer 1, for example the hydro pump 27, in subsequent operating cycles.

The piston chamber 21 and the annular chamber 22 of the differential cylinder 2, in order for any negative pressures that can potentially arise in the hydraulic system to be equalized, in terms of fluid technology are connected to the hydraulic tank 15 by way of suction valves 25 in such a manner that hydraulic fluid 30 in the case of any negative pressure can be suctioned from the hydraulic tank 15 by way of the suction valves 25 and can thus be introduced into the hydraulic system.

In particular, the piston chamber 21 and the annular chamber 22 in terms of fluid technology can each be connected to the hydraulic tank 15 or to a hydraulic fluid source, by way of one suction valve 25 such that hydraulic fluid in the case of any negative pressure is suctioned into the piston chamber 21 or the annular chamber 22 by way of a suction effect that is caused by the negative pressure.

The suction valves 25 can be spring-loaded non-return valves, for example, or other equivalent valves, which permit only a unidirectional flow of hydraulic fluid in the direction from the hydraulic tank 15 to the piston chamber 21 or the annular chamber 22, but block the flow in the opposite direction.

An exemplary operating mode of the forging hammer 1 based on the components described above will be described hereunder by means of FIGS. 2 to 5 which show the forging hammer 1 in various operating states.

Figure 2:
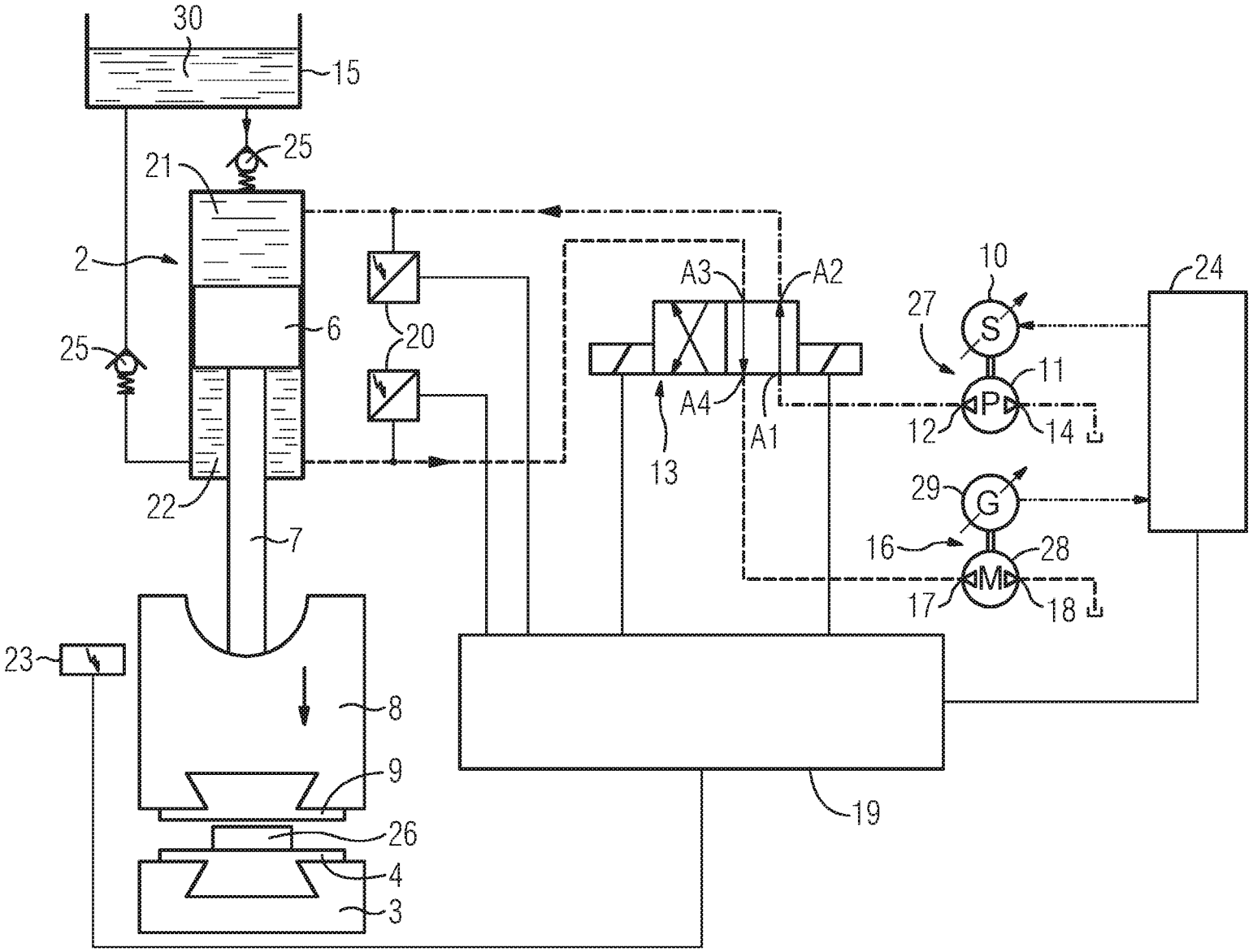
FIG. 2 shows the forging hammer as per FIG. 1 in a first operating state.

FIG. 2 shows the forging hammer 1 in an operating state in which the hydro pump 27 and the multi-way valve 13 are controlled by the control unit 19 in such a manner that the piston 6 of the differential cylinder 2 for the purpose of machining a workpiece 26 is accelerated or moved in the direction of the lower tool 4.

The multi-way valve 13 in the present exemplary embodiment is embodied as a 4/2-way valve, and in the operating state shown in FIG. 1 is switched such that a first connector A1 which in terms of fluid technology is connected to the pressure side 12 of the hydraulic pump 11 is switched so as to communicate with a second connector A2 which in terms of fluid technology is connected to the piston chamber 21. In this way, hydraulic fluid 30 by way of controlling the servomotor 10 in a corresponding manner can be pumped by the hydraulic pump 11 from the hydraulic tank 15 into the piston chamber 21 in order for the stroke of the piston 6 to thus be enlarged and for a hydraulic acceleration force to be transmitted to the piston 6.

Furthermore in the operating state shown in FIG. 1, in which the piston 6 is accelerated or moved in the direction of the lower tool 4, respectively, a third connector A3 of the multi-way valve 13 in terms of fluid technology is connected to the annular chamber 22 and switched so as to communicate with a fourth connector A4 of the multi-way valve 13, said fourth connector A4 in terms of fluid technology being connected to the hydro generator 16, more specifically to the input side 17 of the hydro motor 28.

Since the forging hammer 1 in the present example is configured as a downstroke forging hammer 1 having an overhead differential cylinder 2, apart from the hydraulic forces that are generated by the hydro pump 27 and by the hydro generator 16, the weight forces of the moving mass, in particular of the ram 8, the piston rod 7, the piston 6, the upper tool 9, etc., also contribute toward the acceleration of the ram 8 in the direction of the lower tool 4.

In the case of an upstroke forging hammer or an upstroke forging ram, to which the present invention can likewise be applied, the weight forces act counter to the hydraulic force in the acceleration of the ram in the direction of the workpiece to be machined, this in terms of control technology likewise being able to be detected by the hydraulic system proposed herein. In the case of a combination of a downstroke and an upstroke forging hammer, both the downstroke forging hammer and the upstroke forging hammer can be controlled by the method proposed herein and be of a respective construction.

Reverting to the state shown in FIG. 1, it is furthermore explained that the ram 8 in the operating state shown is impinged with hydraulic fluid 30 by the hydro pump 27 in such a manner, and the hydro generator 16, to the extent required, scavenges hydraulic energy from the hydraulic system and acts as a hydraulic brake to such an extent, that the upper tool 9 when impacting the workpiece 29 to be machined has a respective desired impact speed or terminal speed, respectively, and a respective desired or pre-defined acceleration, respectively, forming energy can be imparted to the workpiece.

In order for the acceleration of the ram 8 to be controlled and for the speed of the ram 8 to be set, the control unit 19 can evaluate one or a plurality of positions and/or speed sensors 23, and by means of the data obtained on account thereof, for example by means of the determined actual speed of the ram 8, or in a corresponding manner of the upper tool 9 or of the piston 6, can control the hydro pump 28 and/or the hydro generator 16 in such a manner that the desired terminal speed is reached.

During the movement of the ram 8 or of the piston 6, respectively, in the direction of the workpiece 26 or of the lower tool 4, hydraulic fluid 30, in a manner corresponding to the volumetric flow that is generated by the hydraulic pump 11, flows into the piston chamber 21. At the same time, hydraulic fluid 30 that is located in the annular chamber 22 is displaced from the annular chamber 22, said hydraulic fluid 30 being returned into the hydraulic tank 15 by way of the multi-way valve 13 and of the hydro generator 16.

In that the hydro generator 16 is disposed in the return line, elastic energy that is stored in the hydraulic system, for example, can be scavenged from the hydraulic system and be converted to electric energy. The electric energy in turn can be temporarily stored in the energy accumulator and in subsequent operating cycles or else directly be provided to the forging hammer 1. Elastic energy that is stored in the hydraulic system can be released by decompressing the hydraulic fluid 30, for example.

Furthermore, hydraulic energy can be scavenged from the hydraulic circuit by controlling the hydro generator 16, that is the servo generator 29, in a corresponding manner in that, for example, the torque of the servo generator 29 is increased such that kinetic energy of the hydraulic fluid flowing through the hydro motor 28 is converted to electric energy. The latter leads to a braking effect, such that the moving mass, in particular the piston 6, the ram 8, etc., can be decelerated in a targeted manner.

This means that the hydro generator 16 in the hydraulic system proposed herein can be operated as hydro-fluidic brake for generating a braking effect on the moving mass, in particular on the ram 8. For example, the hydro-fluidic brake effect can be employed for the purpose of setting a respective required terminal speed in the movement in the direction of the first reversal point U1, and/or for decelerating the moving mass in the movement in the direction of the second reversal point U2, for example in the region of the upper second reversal point, while controlling the hydro generator 16 in a corresponding manner.

By way of the solution proposed herein, the hydro pump 27 and the hydro generator 16 are operable in a substantially simultaneous manner at any time during the entire operating cycle, wherein the hydro pump 27 enables a (positive) acceleration force to be generated, and the hydro generator 16 enables a braking force acting counter to the former to be generated. In particular on account thereof, comparatively accurate and precise controlling of the motion sequence of, for example, the ram 9, substantially during the entire operating cycle of the forging hammer 1, that is to say for example apart from temporal portions in which the multi-way valve 13 is being switched, can be achieved.

Any potential negative pressures that arise in the hydraulic system, that is to say in the piston-chamber side of the hydraulic system, in the case of the forging hammer 1 shown can be equalized in particular in that hydraulic fluid 30 can flow by way of the suction valve 25 that in terms of fluid technology is connected to the piston chamber 21 and to the hydraulic tank 15.

Negative pressures in the piston-chamber side part of the hydraulic system can arise, for example, when the volumetric flow of hydraulic fluid 30 that is generated by the hydro pump 27 during the acceleration of the ram 8 lags behind the volumetric variation that is caused by the enlargement of the piston chamber 21. The latter can arise, for example, when the volumetric variation of the piston chamber 21 that is caused by the accelerating effect of gravity is greater than the volumetric flow of hydraulic fluid 30 that is provided by the hydro pump 27.

For example, the volumetric flow of the hydraulic pump can be reduced following the expiry of a pre-defined acceleration period or phase, that is to say at or following the end of the hydraulic filling period of the piston, such that the piston can reach the respective pre-defined terminal speed.

In exemplary operating sequences, the time required for moving the ram 8 from a second reversal point U2 of the piston 6 or of the ram 8 that is remote from the lower tool 4 to the first reversal point U1 can be approximately 200 ms (milliseconds).

With a view to the quite significant masses to be moved which in the case of forging hammers can be up to several tons, and with a view to the comparatively high terminal speeds, correspondingly high hydraulic outputs which moreover have to be tuned and controlled in a comparatively short time and moreover with great accuracy are required.

Moreover, comparatively high volumetric flows of hydraulic fluid and comparatively high flow velocities arise in the hydraulic circuit in the case of forging hammers, said volumetric flows and flow velocities having to be controlled in a corresponding manner in order for a safe and reliable operation to be ensured.

The objects and challenges mentioned above in particular can be overcome by way of the forming machines proposed and described herein, in particular by way of the hydraulic system proposed herein.

Figure 3:
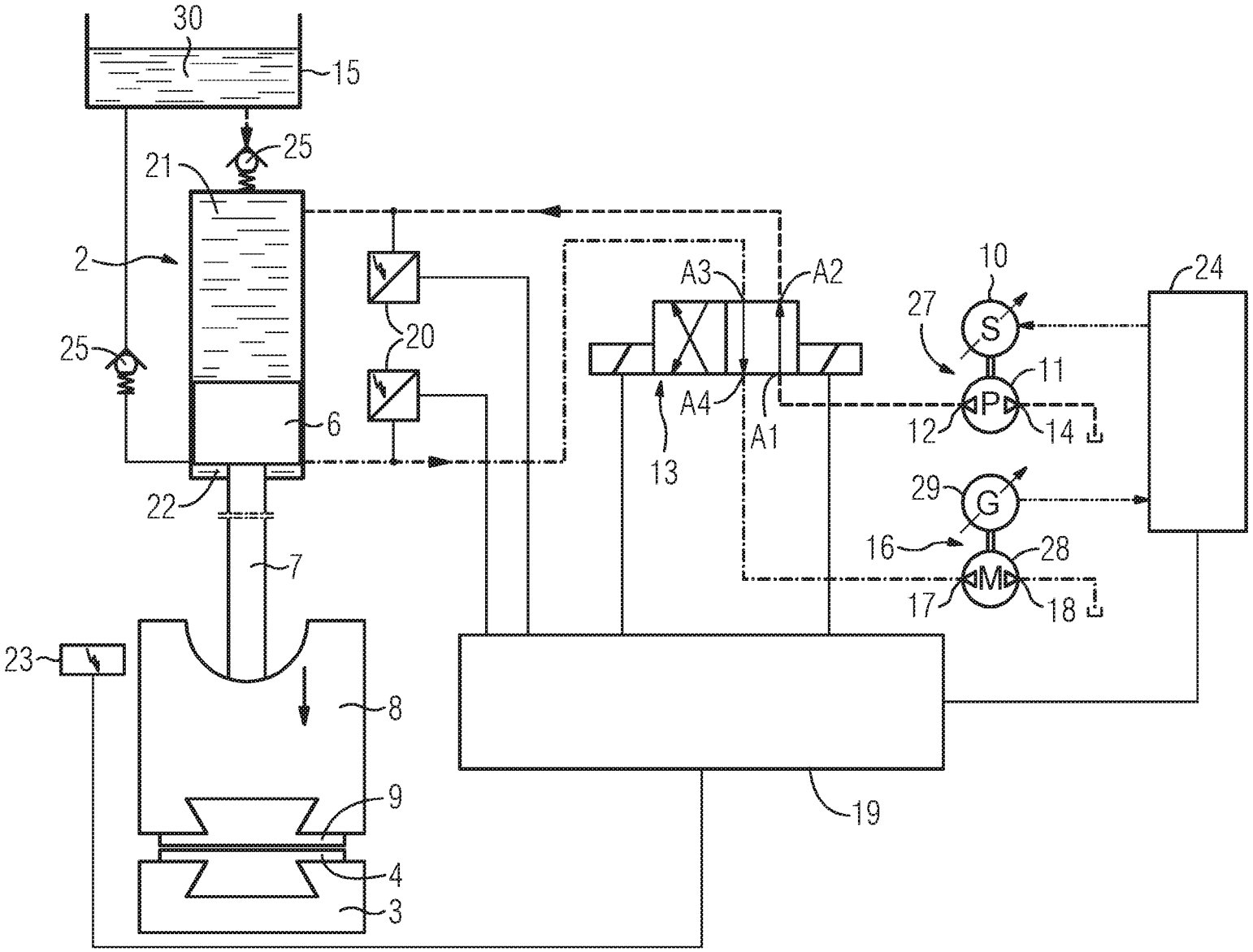
FIG. 3 shows the forging hammer as per FIG. 1 in a second operating state.

FIG. 3 shows the forging hammer 1 in an operating state in which the ram 8 is at the first reversal point U1, that is to say presently the lower reversal point. In that the ram 8, in particular the upper tool 9, impacts the workpiece 26, the respective moving mass comprising in particular the mass of the ram 8, of the upper tool 9, of the piston 6, of the piston rod 7, is decelerated, wherein the dynamic energy is introduced as forming energy into the workpiece 26 in order for the latter to be formed.

It is possible for the terminal speed of the ram 8 to be set in a comparatively accurate manner in particular by way of the hydraulic system proposed herein, having hydro pump 27 and hydro generator 16 that are operable simultaneously during the operating cycle, such that advantageous forging results can be obtained.

In the region of the impact of the upper tool 9 on the workpiece 26, or directly following said impact, a rebound which in particular depending on the material of the workpiece is more or less pronounced can arise on the decelerated mass, said rebound entailing an acceleration in a direction that points away from the lower tool 4. The impact and the rebound can take place in a temporal period of 0.5 ms to 20 ms, for example.

On account of the rebound, the piston 6 in particular is moved abruptly from the first reversal point U1 in the direction of the second reversal point U2. On account thereof, a displacement effect is created in the piston chamber 21 in respect of the hydraulic fluid that is located in the latter, on the one hand, and a negative pressure and, in a manner corresponding thereto, a suction effect are created in the annular chamber 22, or in the annular chamber 22 being created, respectively, on the other hand.

In order to take account of the changed conditions in the hydraulic system in the region of the impact and/or of the first reversal point, the multi-way valve 13 is controlled in a corresponding manner by the control unit 19, in particular in such a manner that the third connector A3 in terms of fluid technology is connected to the first connector A1, and that the second connector A2 in terms of fluid technology is connected to the fourth connector A4 of the multi-way valve 13. On account thereof, the piston chamber 21 in terms of fluid technology is connected to the hydro generator 16, and the annular chamber 22 in terms of fluid technology is connected to the pressure side 12 of the hydraulic pump 11. A respective switching reversal of the multi-way valve 23 in temporal terms can also be performed ahead of the first reversal point U1, for example at the point in time at which the ram 9 is at the desired terminal speed. For example, switching of the multi-way valve 23 can be performed at a point in time at which the respective desired terminal speed is reached, and any optionally required deceleration, or a deceleration procedure, of the piston 6 or of the ram 8 has been completed. The deceleration procedure can be performed, for example, in the final portion of the movement of the ram 8 in the direction of the forming region, or in the direction of the workpiece 26, respectively. The end of the deceleration procedure in temporal terms can be ahead of the point in time of impact of the ram 8 in the operating region. To this extent, switching of the multi-way valve 23 in temporal terms can be performed in particular shortly ahead of the point in time of impact, in particular in such a manner that the respective required switching position of the multi-way valve 23 is present at least at the point in time of impact.

In general, controlling of the multi-way valve 23 can be performed in such a manner that control procedures, in particular taking into account any potential system inertia or switching times, are initiated in a temporally advanced manner such that the switched position of the multi-way valve 23 required for a specific point in time is reliably achieved at the respective point in time.

Figure 4:
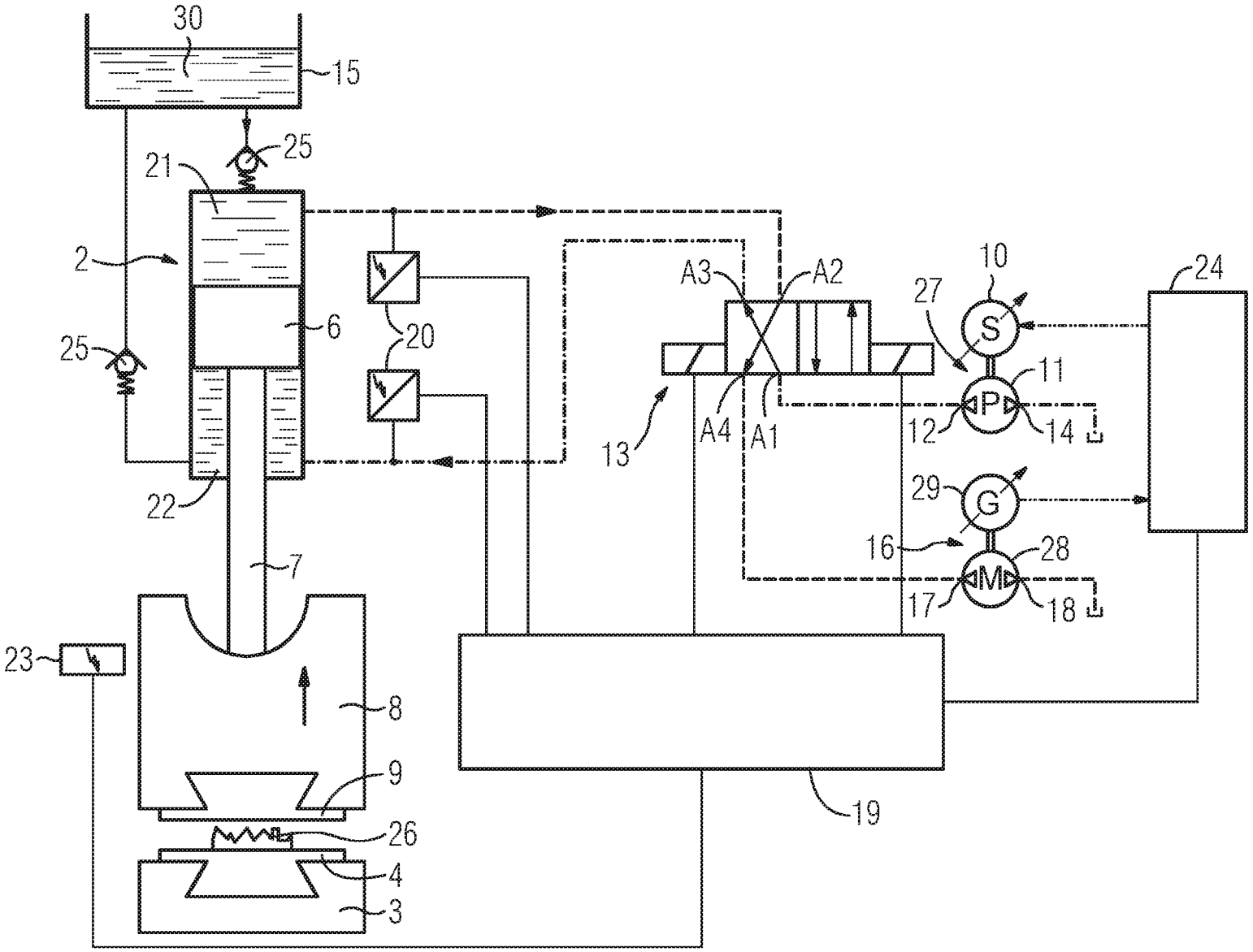
FIG. 4 shows the forging hammer as per FIG. 1 in a third operating state.

In the switched position of the multi-way valve 13 that is shown in the operating state of FIG. 4, hydraulic fluid 30 that on account of the displacement effect has been displaced from the piston chamber 21 can be discharged by way of the hydro generator 16 into the hydraulic tank 15. In particular, the elastic energy that has been generated, for example, by the rebound in the hydraulic system and been released by decompressing the hydraulic system can be converted to electric energy by the hydro generator 16, wherein the hydro generator 16 by way of the servo generator 29 is controlled in a corresponding manner such that the former, driven by the hydro motor 28, can convert the elastic energy at least in part to electric energy.

The electric energy can be stored in the energy accumulator 24 which in electric terms is connected to the servo generator 29, said electric energy being able to be used, for example, for subsequent operating cycles in order for inter alia the hydro pump 27 to be electrically driven.

Furthermore, on account of the connection in terms of fluid technology between the hydro pump 27 and the annular chamber 22, hydraulic fluid 30 can be supplied to the annular chamber 22, in order for the hydraulic fluid that on account of the movement of the piston in the direction of the second reversal point U2 is required in the annular space 22 to be provided at least in part, or in order for the annular chamber 22 to be supplied with hydraulic fluid 30 so as to correspond at least in part to the movement of the piston 6.

On account of the comparatively high accelerations that arise in the case of the rebound, it can happen that the volumetric variation of the annular chamber 22 that is caused by the movement of the piston 6 in the direction of the second reversal point U2 is greater than the volumetric flow that is delivered by the hydro pump 27. In this situation, despite the hydro pump 27 being active, a negative pressure, or a suction effect, respectively, can be created on the side of the annular chamber, said negative pressure or suction effect according to the solution proposed herein being able to be equalized by the suction valve 25 on the annular chamber side. The annular chamber 22 on account of the suction valve 25 on the annular chamber side, in terms of fluid technology is connected to the hydraulic tank 15 such that, caused by the suction effect, hydraulic fluid 30 can flow from the hydraulic tank 15 into the annular chamber 22.

As has already been mentioned, the suction valve or valves 25, respectively, can be configured as non-return valves and offer the potential of absorbing negative-pressure surges in the hydraulic system without total control of the hydraulic system by way of the control unit 19 being required to this end.

In particular, in order for negative-pressure surges, or negative pressures in general, to be equalized, it is not necessary for the hydro pump 27, for example in the region of the rebound, to be operated at a correspondingly increased rotational speed and at a correspondingly higher conveying output. Instead, following switching of the multi-way valve 13 in a manner corresponding to the configuration as per FIG. 4, in which the hydro pump 27 in terms of fluid technology is connected to the annular chamber 22, and the hydro generator 16 in terms of fluid technology is connected to the piston chamber 21, the hydro pump 27 can be operated by the control unit 19 for example at a minimum rotational speed, or a minimum conveying output, respectively, that is required in order for the piston 6, upon the rebound having abated, to be moved at the speed that is required in each case to the second reversal point U2. The control complexity in particular can be reduced in this way.

The movement of the piston 6 from the first U1 to the second reversal point U2 in exemplary operating cycles can be performed in approximately 500 ms, for example.

The control unit 19, when reaching the second reversal point U2 or in a temporal period ahead of reaching the latter, can control the hydraulic circuit, in particular the multi-way valve 13 and the hydro pump 27 and the hydro generator 16 in such a manner that the piston 6 is decelarated conjointly with the moving mass connected to the latter. The deceleration procedure in exemplary operating cycles can be performed in a temporal duration of approx. 100 ms, for example.

The control unit 19, in order for the piston 6 and the mass moved thereby to be decelerated in the region of the second reversal point U2, can actuate the hydro generator 16 in such a manner that hydraulic energy is scavenged by the hydro generator 16 from the hydraulic fluid that flows back from the piston chamber 21, such that the hydro generator 16 acts as a hydro-fluidic brake.

At the same time, in as far as this has not already happened, the hydro pump 27 can be controlled in such a manner that the quantity conveyed by the latter is or is to be reduced, for example in such a manner that the hydro pump 27 is operated at the minimum rotational speed.

In the case of a downstroke operated forging hammer, the gravity that in the decelaration acts on the moving mass in a manner corresponding to the figures acts in an additionally decelerating manner in terms of the movement in the direction of the second reversal point U2.

The hydraulic system, in order to decelerate in the region of the second reversal point U2, optionally using detected sensor-based position and/or speed data of the ram 8, is in any case controlled such that the ram 8 is completely decelerated at the second reversal point U2. It is to be noted only for the sake of completeness that the deceleration of the moving mass at the first reversal point U1 is performed by the forging procedure per se, wherein effects such as the rebound in the case of the first reversal point U1 are however to be absorbed or managed by controlling the hydraulic system in a corresponding manner.

The control unit 19, following the deceleration at the second reversal point U2, can control the hydraulic system in a manner corresponding to the sequence diagram described earlier in order for a further operating cycle to be carried out. The control unit 19 herein can control the multi-way valve 13 in such a manner that the hydro pump 27, as is shown in FIG. 2, in terms of fluid technology is again connected to the piston chamber 21, and the hydro generator 16 in terms of fluid technology is again connected to the annular chamber 22.

To the extent that an impact speed that is different from, for instance, that of a preceding operating cycle is required in a subsequent operating cycle, the hydro pump 27 and the hydro generator 16 for setting the defined impact speed can be controlled in a corresponding manner in the acceleration of the moving mass, and optionally in the deceleration of the moving mass.

It is to be noted here that any modification or variation of the impact speed can be established in a comparatively simple manner by way of the hydraulic system proposed herein and of the switching plan proposed herein of the hydro pump 27, of the multi-way valve 13, and of the hydro generator 16 and of the controller 19 connected thereto. In particular, by way of the system proposed herein, changes in terms of parameters can be reacted to in a comparatively flexible manner by a corresponding variation in terms of control, optionally by additionally evaluating pressure, position, or speed sensors.

Figure 5:
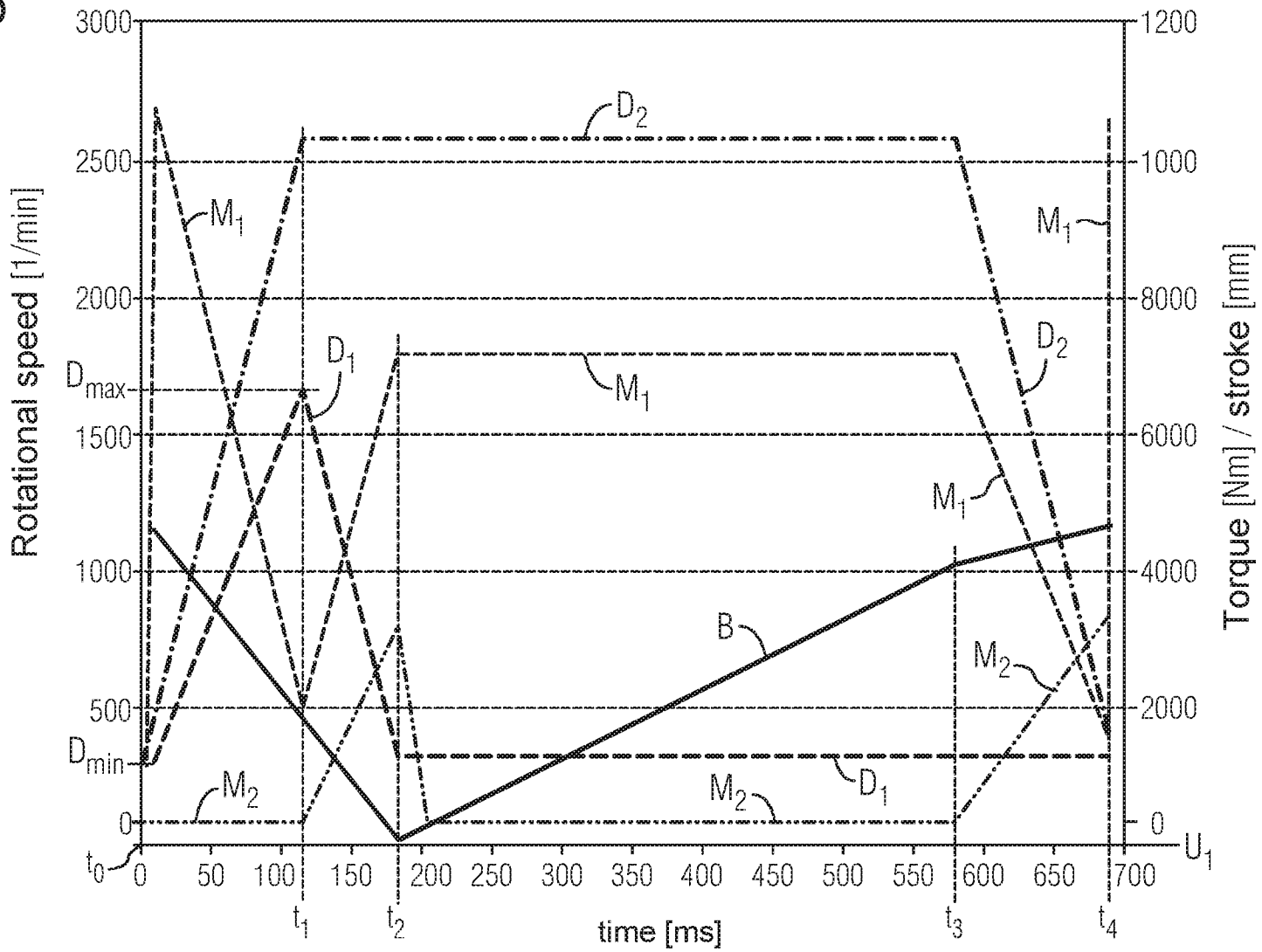
FIG. 5 shows an operating diagram relating to the operation and control variables of the forging hammer.

FIG. 5 shows an operating diagram relating to operation and control variables of the forging hammer 1, wherein a total of five curves are illustrated, wherein a first rotational speed curve D1 describes the temporal correlation, or the temporal profile of the rotational speed of the hydraulic pump 11, respectively. A second rotational speed curve D2 describes the temporal correlation, or the temporal profile of the rotational speed of the hydro generator 16, respectively.

A first torque curve M1 describes the temporal correlation or the temporal profile of the torque of the hydraulic pump 11, respectively, and a second torque curve M2 shows the temporal correlation or the temporal profile of the torque of the hydro generator 16, respectively.

A movement curve B describes the temporal correlation or the temporal profile of the stroke of the piston 6 or of the ram 8, respectively. According to the movement curve B, the piston moves from the second reversal point U2 to the first reversal point U1, and then back again to the second reversal point U2.

In the motion sequence as per the movement curve B, shown in an exemplary manner, the piston 6 or the ram 8, respectively, so as to correspond to a start of an operating cycle, at a starting point in time t0 at t=0 is located at the second reversal point U2. The ram 8, or the piston 6, respectively, is accelerated from the second reversal point U2 in the direction of the first reversal point U1, wherein the multi-way valve 13 is controlled in such a manner that the hydro pump 27 in terms of fluid technology is connected to the piston chamber 21. The hydro generator 16 in this operating state, in terms of fluid technology, is connected to the annular chamber 22.

For acceleration, the pump torque of the hydro pump 27 and thus the output that is transmittable into the hydraulic system is increased in a manner corresponding to a comparatively steep flank, in the present exemplary curve as per FIG. 5 to approximately 1100 Nm.

As the speed of the ram 8 increases, the torque required for accelerating the ram 9 drops, not least because the gravity of the moving mass contributes toward the acceleration. The ram 8 and the moving mass is accelerated up to a first point in time t1 which is ahead of a second point in time t2 at which the ram 8 reaches the first reversal point U1.

The rotational speed of the hydro pump 27, in a manner coinciding with the increasing speed of the ram 8 or of the piston 6, respectively, increases from the minimum rotational speed Dmin up to the maximum rotational speed Dmax, in a manner corresponding with the volumetric variation of the piston chamber 21 that is caused by the movement of the piston 6. In the same temporal period between t0 and t1 hydraulic fluid 30 is displaced at an increasing volumetric flow from the annular chamber 21, wherein the rotational speed of the hydro generator 16, that is to say the rotational speed of the hydro motor 28 of the hydro generator 16 increases in a manner so as to coincide with the increasing volumetric flow.

A setting of the respective terminal speed can optionally be performed in the temporal period between the first point in time t1 and the impact point, the latter corresponding substantially to the second point in time t2 that is assigned to the first reversal point U1, in other words in the temporal period between the end of the acceleration phase and the point in time of impact.

The multi-way valve 13, in order for the speed to be set, can be switched such that the hydro pump 27 is connected to the annular chamber 22, and the hydro generator 16 is connected to the piston chamber 21. As is shown in an exemplary manner in the diagram, the torque of the hydro generator 16 herein can be increased in the temporal period between t1 and t2, which means in particular that energy is scavenged from the hydraulic fluid that flows into the piston chamber, this ultimately decelerating the volumetric flow to the piston chamber 21, on account of which a braking effect on the ram 9 can be generated. That is to say that the hydro generator 16 in this temporal period acts as a hydro-fluidic brake in order to optionally counteract any further acceleration of the ram 8 upon reaching the terminal speed.

The rotational speed of the hydro generator 16 at the point in time mentioned between t1 and t2 is approximately constant (cf. curve D2). Ahead of the point in time t1, in the temporal interval between t0 and t1 in the example of FIG. 5, the rotational speed of the hydro generator 16 can be set to, in particular increased to, the rotational speed that is required for the generative operation.

The torque of the hydro generator 16 (cf. curve M2) increases up to the second point in time t2, which can mean, for example, that the hydro generator 16 in actual fact does scavenge hydraulic energy from the hydraulic system.

With a view to the profiles of the torque and of the rotational speed of the hydro motor 28 and of the hydro generator 16 that are shown in FIG. 5 and stated in an exemplary manner, it is to be mentioned that the respective actual profile of the curves can deviate so as to depend on the respective hydraulic system. For example, the profile of the rotational speed and/or of the torque can be temporally offset in relation to the points in time t0 to t4, which can be caused, for example, by different mass inertias and/or fluid inertias of the hydraulic fluid and/or of components of the hydraulic system. For example, the increase in the rotational speed of the hydro generator 16 ahead of the point in time t1 to the rotational speed that is required or suitable for the generative operation can also be achieved in a manner other than by the profile shown in FIG. 5. In other words, the rotational speed and the torque of the hydro motor and/or the hydro generator of different forging hammers can deviate from the profile shown in FIG. 5, so as to depend on the respective conception and dimensioning in particular of the hydraulic system.

At the same time, the hydro pump 27 in the temporal period between t1 and t2 is controlled in such a manner that the rotational speed drops to the minimum rotational speed Dmin, wherein the torque increases upon reaching the terminal speed.

It should be mentioned herein that the rotational speed and the torque of the hydro pump 27 are set in such a manner that the piston from the second point in time t2 can be moved at a pre-defined return speed, for example 2 m/s, from the first reversal point U1 in the direction of the second reversal point U2.

The hydro pump 27 from the second point in time t2 on, in a manner corresponding to the exemplary profile shown in FIG. 5, is operated so as to correspond to the previously set minimum rotational speed Mmin and the respective torque, and the ram 8, or the piston 6, respectively, are moved from the first reversal point U1 to the second reversal point U2. In order for the hydro generator 16 not to act as a hydraulic brake in the return movement and not to act on the hydro pump 27 in a decelerating manner, the torque of the hydro generator 16 after the second temporal period is reduced to zero.

The rotational speed of the hydro generator 16, that is to say of the hydro motor 28, in this temporal period is the result of in particular the volumetric flow of the hydraulic fluid 30 that is displaced from the piston chamber 21.

The return movement of the piston 6 from a third point in time t3 on is slowed down in such a manner that the piston 6 conjointly with the moving mass connected therewith is decelerated at the second reversal point U2, and that the operating cycle can be repeated.

For deceleration, the torque of the hydro generator 16 is increased such that the latter acts as a hydraulic brake for decelerating the mass moving in the direction of the second reversal point U2. In a manner coinciding therewith, the torque of the hydro pump 27 is reduced, this likewise leading to the return movement being slowed down. On account of these measures and of the acting gravity, the moving mass is completely decelerated up to a fourth point in time t4 which defines the end of the operating cycle.

A further operating cycle which is carried out so as to correspond to the operating cycle described above can follow on from the fourth point in time, wherein upon switching reversal of the multi-way valve 13, the hydro pump 27 is again connected to the piston chamber 21, and the hydro generator 16 is again connected to the annular chamber 22.

It is demonstrated overall that comparatively accurate controlling of the hydro motor 28 and of the hydro generator 16 is possible by means of the proposed hydraulic system in such a manner that the ram 8 can be controlled so as to correspond to a respective pre-defined motion sequence and movement and speed profile, and any lost energy arising in the hydraulic system can at the same time be converted to useful energy. Comparatively accurate and energy-efficient operating cycles for the differential cylinder 2 and the forging hammer 1 can be implemented by the controller proposed herein and the construction of the hydraulic system of the forging hammer proposed herein.

A comparatively accurate and reliable setting of the motion sequence and of the speed, in particular of the terminal speed, or the impact speed, respectively, of the ram 9 can be achieved in particular on account of the potential of the simultaneous operation of the hydro pump 27 and of the hydro generator 16.

Controlling of the arrangement proposed herein, consisting of the hydro pump, the hydro generator, and the multi-way valve, can be relieved and simplified by way of the suction valves 25, for example, which can equalize any states of negative pressure and pressure surges, for example hydraulic shocks to the piston, the hydro pump, the hydro generator, and/or the multi-way valve assembly, in the hydraulic system in a quasi automatic manner. The latter not only has an advantageous effect on the controlling complexity, but a comparatively wear-free operation can also be simultaneously achieved.

LIST OF REFERENCE SIGNS

1 Forging hammer
2 Differential cylinder
3 Lower die
4 Lower tool
5 Cylinder tube
6 Piston
7 Piston rod
8 Ram
9 Upper tool
10 Servomotor
11 Hydraulic pump
12 Pressure side
13 Multi-way valve
14 Suction side
15 Hydraulic tank
16 Hydro generator
17 Input side
18 Output side
19 Control unit
20 Pressure sensor
21 Piston chamber
22 Annular chamber
23 Position or speed sensor
24 Energy accumulator
25 Suction valve
26 Workpiece
27 Servomotor-assisted hydro pump
28 Hydro motor
29 Servo generator
30 Hydraulic fluid
U1 First reversal point
U2 Second reversal point
A1-A4 First to fourth connectors
D1, D2 Rotational speed curve
M1, M2 Torque curve
B Movement curve
t0 Starting point in time
t1-t4 First to fourth point in time
Dmin Minimum rotational speed
Dmax Maximum rotational speed

We claim:

1. A forging hammer, for machining workpieces by forming, comprising:

a striking tool;

a hydraulic differential cylinder coupled to the striking tool and configured for driving the striking tool;

a multi-way valve assembly, a servomotorical hydro generator, a servomotorical hydro pump, and a control unit, the hydraulic differential cylinder disposed via the multi-way valve assembly fluidically downstream of the hydro pump, the servomotorical hydro generator disposed via the multi-way valve assembly fluidically downstream of the hydraulic differential cylinder;

the control unit configured for controlling the servomotorical hydro pump, the servomotorical hydro generator, and the multi-way valve assembly, such that the servomotorical hydro generator and the servomotorical hydro pump operate unidirectionally with the same direction of rotation in successive operating cycles.

2. The forging hammer as claimed in claim 1, wherein:

the control unit is configured such that the multi-way valve assembly at least at times during an operating movement of the hydraulic differential cylinder is actuated such that the servomotorical hydro pump is fluidically connected to a first fluid chamber of the hydraulic differential cylinder, and the servomotorical hydro generator is fluidically connected to a second fluid chamber of the hydraulic differential cylinder, and such that the multi-way valve assembly at least at times during a return movement of the hydraulic differential cylinder is actuated; such that the servomotorical hydro pump is fluidically connected to the second fluid chamber, and the servomotorical hydro generator is fluidically connected to the first fluid chamber of the hydraulic differential cylinder; and/or the control unit is configured such that the servomotorical hydro pump in directly successive portions of an operating cycle of the hydraulic differential cylinder is connected alternatingly to a or the first fluid chamber and to a or the second fluid chamber of the hydraulic differential cylinder, respectively, and such that the servomotorical hydro generator is connected alternatingly to the second fluid chamber and to the first fluid chamber, respectively.

3. The forging hammer as claimed in claim 1, wherein:

the multi-way valve assembly comprises a 4/2-way valve or at least four individual hydraulic valves which are fluidically interconnected in accordance with a hydraulic bridge circuit;

wherein the hydraulic bridge circuit is implemented as one of a polygonal circuit of four hydraulic valves having interdisposed connection points, and a parallel circuit with two hydraulic valves, respectively, switched in series; and/or the forging hammer comprises at least one of:

a plurality of servomotorical hydro pumps that are fluidically switched in parallel, and/or a plurality of servomotorical hydro generators that are fluidically switched in parallel.

4. The forging hammer as claimed in claim 2, comprising:

at least one suction valve which is fluidically connected to a suction source, on the one hand, and to at least one fluid chamber of the hydraulic differential cylinder on the other hand; wherein the suction valve in terms of fluid technology is configured in such a manner that a negative pressure that is created in the at least one fluid chamber in the operation of the hydraulic differential cylinder is equalizable by suctioning hydraulic fluid via the suction valve from the suction source.

5. The forging hammer as claimed in claim 1, wherein:

the control unit is configured for controlling the rotational speed of the servomotorical hydro pump in such a manner that the servomotorical hydro pump during the operation is operated at least at a minimum rotational speed (Dmin) that is unequal to zero, wherein the rotational speed of the servomotorical hydro pump in an operating range of an operating cycle of the hydraulic differential cylinder initially is increased from the minimum rotational speed (Dmin) to a maximum rotational speed (Dmax) and subsequently is decreased from the maximum rotational speed (Dmax) to the minimum rotational speed (Dmin); and/or wherein the control unit is configured such that the servomotorical hydro pump during a plurality of directly successive operating cycles is at all times operated at least at the minimum rotational speed (Dmin), and wherein the control unit is configured such that the servomotorical hydraulic pump initially is activated at the minimum rotational speed (Dmin) and subsequently the rotational speed of the servomotorical hydro pump in an operating range of an operating cycle of the hydraulic differential cylinder initially is increased from the minimum rotational speed (Dmin) to a maximum rotational speed (Dmax), and in a subsequent operating cycle the rotational speed of the servomotorical hydro pump is decreased from the maximum rotational speed (Dmax) to the minimum rotational speed (Dmin), in such a manner that the minimum rotational speed (Dmin) is reached at a reversal point of the hydraulic differential cylinder; and/or the control unit is configured such that when a predefined terminal speed of the striking tool is reached the rotational speed of the servomotorical hydro pump is decreased when reaching the maximum rotational speed (Dmax) such that the predefined terminal speed under the influence of at least one of hydraulic forces and the force of gravity that acts on the striking tool is reached at or shortly or directly ahead of the reversal point or the forming point, or at or shortly or directly ahead of the reversal point of the forming point, and/or wherein for setting the terminal speed the servomotorical hydro generator is operated as a hydraulic brake in order for the hydraulic piston to be actively decelerated.

6. The forging hammer as claimed in claim 1, wherein:

the control unit is configured and specified for controlling the servomotorical hydro pump in such a manner that a maximum advancing speed of the differential cylinder is in the range between 1.0 to 6 m/s, and/or the control unit is configured such that an initial point for starting a forming or forging procedure is set in dependence on a respectively required terminal speed depending on the height of the workpiece to be formed, the height measured in the movement direction of the piston of the hydraulic differential cylinder; and/or the control unit is configured such that the path traveled by the striking tool during a forging cycle is minimal, and/or the control unit is configured such that a striking energy of a last-performed stroke is used for calculating the starting position of a piston of the hydraulic differential cylinder based on a subsequently required striking energy; and/or the control unit is configured such that a position of the piston of the hydraulic differential cylinder is determined at the commencement of or at a defined point in time during a forming or forging cycle and is used as a calculation basis for at least one of:

determining an initial position of the piston, and determining operating parameters for controlling the movements of the piston of the hydraulic differential cylinder for a temporally successive forming or forging procedure.

7. The forging hammer as claimed in claim 1, further comprising an energy accumulator which for the purpose of feeding electrical energy that is generated by the servomotorical hydro generator is connected to the servomotorical hydro generator.

8. A method for controlling an operating cycle of a forging hammer, comprising:

driving a hydraulic differential cylinder that is coupled to a striking tool by supplying hydraulic fluid by way of a servomotorical hydro pump, said servomotorical hydro pump being fluidically coupled to the hydraulic differential cylinder via a multi-way valve assembly that is disposed fluidically upstream of said hydraulic differential cylinder;

directing hydraulic fluid that flows off from the hydraulic differential cylinder by way of the multi-way valve assembly to a servomotorical hydro generator that is disposed fluidically downstream of the multi-way valve assembly; and operating, by controlling the multi-way valve assembly, the servomotorical hydro generator unidirectionally with the same direction of rotation in successive operating cycles.

9. A method for controlling an operating cycle of a forging hammer, comprising:

driving a hydraulic differential cylinder that is coupled to a striking tool by supplying hydraulic fluid by way of a servomotorical hydro pump, said servomotorical hydro pump being fluidically coupled to the hydraulic differential cylinder via a multi-way valve assembly that is disposed fluidically upstream of said hydraulic differential cylinder;

directing hydraulic fluid that flows off from the hydraulic differential cylinder by way of the multi-way valve assembly to a servomotorical hydro generator that is disposed fluidically downstream of the multi-way valve assembly;

operating, by controlling the multi-way valve assembly, the servomotorical hydro pump unidirectionally with the same direction of rotation in successive operating cycles;

wherein, so as to coincide with reaching a first reversal point (U1) that is assigned to a forming region of the forging hammer, or when a striking tool of the forging hammer reaches a predefined speed, the method further comprises:

actuating the multi-way valve assembly in such a manner that elastic energy that is stored, generated and/or created in the hydraulic system of the forging hammer by decompressing the hydraulic fluid is converted to electric energy by way of the servomotorical hydro generator.

10. The method as claimed in claim 9, further comprising:

actuating the multi-way valve assembly at least at times during an operating movement of the hydraulic differential cylinder such that:

the servomotorical hydro pump is fluidically connected to a first fluid chamber of the hydraulic differential cylinder, and the servomotorical hydro generator is fluidically connected to a second fluid chamber of the hydraulic differential cylinder, and actuating the multi-way valve assembly at least at times during a return movement of the hydraulic differential cylinder such that the servomotorical hydro pump is fluidically connected to the second fluid chamber, and the servomotorical hydro generator is fluidically connected to the first fluid chamber of the hydraulic differential cylinder, and/or operating the control unit in such a manner that the servomotorical hydro pump in sequentially directly successive portions of an operating cycle of the hydraulic differential cylinder is connected alternatingly to a first fluid chamber and to the second fluid chamber of the hydraulic differential cylinder, respectively, wherein the servomotorical hydro generator is correspondingly fluidically connected alternatingly to the second fluid chamber and to the first fluid chamber.

11. The method as claimed in claim 9, further comprising:

controlling the servomotorical hydro pump in such a manner by the control unit that the servomotorical hydro pump during the operation is operated at least at a minimum rotational speed (Dmin) that is unequal to zero; or controlling the servomotorical hydro pump in such a manner by the control unit that the servomotorical hydro pump during the operation is operated at least at a minimum rotational speed (Dmin) that is unequal to zero, wherein the rotational speed of the servomotorical hydro pump in an operating portion of an operating cycle of the hydraulic differential cylinder initially is at least one of:

increased from the minimum rotational speed (Dmin) to a maximum rotational speed (Dmax), and subsequently decreased from the maximum rotational speed (Dmax) to the minimum rotational speed (Dmin), and set or adjusted to the minimum rotational speed (Dmin) during a return portion of the operating cycle.

12. The method as claimed in claim 9, further comprising:

increasing the rotational speed of the servomotorical hydro pump for accelerating a piston of the hydraulic differential cylinder in the direction of a first reversal point (U1) that is assigned to a forming region of the forging hammer from a minimum rotational speed (Dmin) to a maximum rotational speed (Dmax) in such a manner that the maximum rotational speed (Dmax) is reached ahead of a first reversal point (U1) of the hydraulic differential cylinder that is assigned to the forming region being reached;

decreasing the rotational speed of the servomotorical hydro pump after reaching the maximum rotational speed (Dmax) in such a manner that the minimum rotational speed (Dmin) is reached as or when the first reversal point (U1) is reached, wherein the hydraulic pump at all times during a plurality of directly successive operating cycles is operated at least at the minimum rotational speed (Dmin); or initially activating the servomotorical hydraulic pump at least at the minimum rotational speed (Dmin), and increasing the rotational speed of the servomotorical hydraulic pump subsequently in an operating range of an operating cycle of the hydraulic differential cylinder from the minimum rotational speed (Dmin) to a maximum rotational speed (Dmax); and in a subsequent operating cycle of the servomotorical hydraulic pump decreasing the rotational speed from the maximum rotational speed (Dmax) to the minimum rotational speed (Dmin) in such a manner that the minimum rotational speed (Dmin) is reached at a reversal point of the hydraulic differential cylinder;

when a predefined terminal speed of a striking tool of the forging hammer is reached after reaching the maximum rotational speed (Dmax), decreasing the rotational speed of the pump such that the predefined terminal speed under the influence of the hydraulic forces prevalent in the hydraulic system and under the force of gravity that acts on the striking tool is reached at or shortly or directly ahead of the reversal point of the forming point, wherein for setting the terminal speed the servomotorical hydro generator is operated as a hydraulic brake in order for the piston of the differential hydraulic cylinder to be actively decelerated.

13. The method as claimed in claim 9, wherein:

so as to coincide with reaching a second reversal point (U2) of the hydraulic differential cylinder that faces away from the forming region of the forging hammer, actuating the multi-way valve assembly such that a pressure output of the servomotorical hydro pump is fluidically connected to a first fluid chamber of the hydraulic cylinder and a pressure input of the servomotorical hydro generator is fluidically connected to a second fluid chamber of the hydraulic differential cylinder.

14. The method as claimed in claim 9, comprising:

setting an initial point for starting a forming or forging procedure in dependence on a respectively required terminal speed and in dependence on a height of a workpiece to be formed, the height measured in the movement direction of the piston of the hydraulic differential cylinder such that the path traveled by the striking tool of the forging hammer during a forging cycle is minimal.

15. A method for controlling a forging hammer that comprises a striking tool, a hydraulic differential cylinder coupled to the striking tool and configured for driving the striking tool, a servomotorical hydro pump, with the hydraulic differential cylinder being disposed by way of a multi-way valve assembly fluidically downstream of the servomotorical hydro pump, a servomotorical hydro generator which by way of the multi-way valve assembly is disposed fluidically downstream of the hydraulic differential cylinder; and a control unit which is configured for at least controlling the servomotorical hydro pump, the servomotorical hydro generator, and the multi-way valve assembly, the method comprising:

driving the hydraulic differential cylinder coupled to the striking tool by the supply of hydraulic fluid by way of the servomotorical hydro pump, said servomotorical hydro pump being fluidically coupled to the hydraulic differential cylinder by way of the multi-way valve assembly that is fluidically disposed upstream of said hydraulic differential cylinder;

directing hydraulic fluid from the hydraulic differential cylinder by way of the multi-way valve assembly to the servomotorical hydro generator that is fluidically disposed downstream of the multi-way valve assembly;

controlling the multi-way valve assembly to operate the servomotorical hydro generator as an unidirectional servomotorical hydro generator via a plurality of cycles; and operating the servomotorical hydro pump across the plurality of operating cycles at least at a minimum rotational speed that is unequal to zero.

16. The method as claimed in claim 15, wherein:

secondary energy that is generated by the servomotorical hydro generator in one operating cycle is supplied to the forging hammer in a subsequent operating cycle, and/or a striking energy of a last-performed stroke is used for calculating a starting position of the piston of the hydraulic differential cylinder based on a subsequently required striking energy, and/or an initial position of the piston of the hydraulic differential cylinder is determined at the commencement of or at a defined point in time during a forming or forging cycle and is used as a calculation basis for determining at least one of:

an initial position of the piston of the hydraulic differential cylinder, and/or operating parameters for controlling the movements of the piston of the hydraulic differential cylinder for a temporally successive forming or forging procedure.

17. The method as claimed in claim 9, wherein:

so as to coincide with reaching a first reversal point (U1) that is assigned to a forming region of the forging hammer, or when reaching a predefined speed of a striking tool of the forging hammer, actuating the multi-way valve assembly such that a pressure output of the servomotorical hydro pump is fluidically connected to a second fluid chamber of the hydraulic differential cylinder, and a pressure input of the servomotorical hydro generator is fluidically connected to a first fluid chamber of the hydraulic differential cylinder.

18. The method as claimed in claim 17, wherein:

a negative pressure in the second fluid chamber that is caused by a rebound at the first reversal point (U1) is equalized by a suction valve that is fluidically connected to the second fluid chamber, on the one hand, and to a hydraulic container, on the other hand; and an elastic energy that is generated in the hydraulic fluid by the rebound is converted by the servomotorical hydro generator to electric energy by decompression.

* * * * *